US010641219B2

(12) United States Patent
Nakaoka

(10) Patent No.: US 10,641,219 B2
(45) Date of Patent: May 5, 2020

(54) FUEL PUMP CONTROL DEVICE

(71) Applicant: DENSO CORPORATION, Kariya, Aichi-pref. (JP)

(72) Inventor: Masaharu Nakaoka, Kariya (JP)

(73) Assignee: DENSO CORPORATION, Kariya (JP)

( * ) Notice: Subject to any disclaimer, the term of this patent is extended or adjusted under 35 U.S.C. 154(b) by 126 days.

(21) Appl. No.: 16/071,150

(22) PCT Filed: Dec. 26, 2016

(86) PCT No.: PCT/JP2016/088608
§ 371 (c)(1),
(2) Date: Jul. 19, 2018

(87) PCT Pub. No.: WO2017/138270
PCT Pub. Date: Aug. 17, 2017

(65) Prior Publication Data

US 2019/0093611 A1 Mar. 28, 2019

(30) Foreign Application Priority Data

Feb. 12, 2016 (JP) ..... 2016-024527

(51) Int. Cl.
*F02M 37/20* (2006.01)
*F02M 59/20* (2006.01)
*F02M 59/36* (2006.01)
*F02M 59/24* (2006.01)

(52) U.S. Cl.
CPC ..... *F02M 37/20* (2013.01); *F02M 59/20* (2013.01); *F02M 59/24* (2013.01); *F02M 59/36* (2013.01); *F02M 59/366* (2013.01); *F02M 59/368* (2013.01)

(58) Field of Classification Search
CPC ..... F02M 37/20; F02M 59/20; F02M 59/24; F02M 59/36; F02M 59/366; F02M 59/368
USPC ..... 123/500, 501, 503, 508, 541
See application file for complete search history.

(56) References Cited

U.S. PATENT DOCUMENTS 4,884,549 A * 12/1989 Kelly ..... F02D 41/408 123/506
6,314,945 B1 11/2001 Sugiyama et al.
2005/0161024 A1 7/2005 Wang

FOREIGN PATENT DOCUMENTS

JP 04-353262 12/1992
JP 2002-213326 7/2002
JP 2011-094524 5/2011
JP 2016200085 A * 12/2016 ..... F04B 49/06

* cited by examiner

*Primary Examiner* — Erick R Solis
(74) *Attorney, Agent, or Firm* — Nixon & Vanderhye PC

(57) ABSTRACT

The control device controls a fuel pump which repeatedly executes a discharge operation of pressurizing and discharging fuel in a pressurizing chamber with the pressurizing member. Furthermore, the control device includes: a pressurizing chamber temperature obtaining unit which obtains a pressurizing chamber temperature which is a temperature of the fuel in the pressurizing chamber; and a discharge amount control unit which increases a fuel discharge amount by one discharge operation of the fuel pump when the pressurizing chamber temperature obtained by the pressurizing chamber temperature obtaining unit is higher than a threshold value.

15 Claims, 14 Drawing Sheets

FUEL PUMP CONTROL DEVICE

CROSS REFERENCE TO RELATED APPLICATION

This application is the U.S. national phase of International Application No. PCT/JP2016/088608 flied Dec. 26, 2016, which designated the U.S. and claims priority to Japanese Patent Application No. 2016-24527 filed on Feb. 12, 2016, the entire contents of each of which are hereby incorporated by reference.

TECHNICAL FIELD

The present disclosure relates to a device for controlling a fuel pump that pressurizes and discharges fuel.

BACKGROUND ART

For the purpose of reducing operation noise of a high-pressure fuel pump, Patent Literature 1 discloses a fuel supply device which reduces the number of times of operations of all of multiple high-pressure fuel pumps in a predetermined period when the required fuel amount of an internal combustion engine is small.

The inventors have found that, when the fuel pressure (target fuel pressure) to increase by the high-pressure fuel pump increases (for example, 100 MPa), the temperature of the fuel in a pressurizing chamber excessively increases in the high-pressure fuel pump, and air bubbles are generated by fuel vapor. In Patent Literature 1, generation of air bubbles caused by the fuel vapor is not taken into consideration, and when the target fuel pressure increases, there is a concern that the fuel cannot be appropriately pressurized and discharged by the fuel pump.

PRIOR ART LITERATURE

Patent Literature

Patent Literature 1: JP 2002-213326 A

SUMMARY OF INVENTION

An object of the present disclosure is to provide a fuel pump control device which can prevent generation of air bubbles caused by fuel vapor.

According to a first aspect of the present disclosure, a fuel pump control device controls a fuel pump which repeatedly executes a discharge operation of pressurizing and discharging fuel in a pressurizing chamber with a pressurizing member. The control device includes a pressurizing chamber temperature obtaining unit which obtains a pressurizing chamber temperature which is a temperature of the fuel in the pressurizing chamber; and a discharge amount control unit which increases a fuel discharge amount by one discharge operation of the fuel pump when the pressurizing chamber temperature obtained by the pressurizing chamber temperature obtaining unit is higher than a threshold value.

According to the above-described configuration, the fuel pump repeatedly executes the discharge operation of pressurizing and discharging the fuel in the pressurizing chamber with the pressurizing member. When the fuel in the pressurizing chamber is pressurized by the pressurizing member, the temperature of the pressurized fuel increases. In addition, when the fuel vapor pressure increases above the pressure which acts on the fuel due to the temperature rise of the fuel suctioned into the pressurizing chamber, the fuel boils and the air bubbles are generated by the fuel vapor. As a result, it becomes impossible to fill the pressurizing chamber with the liquid fuel.

The pressurizing chamber temperature obtaining unit obtains the pressurizing chamber temperature which is the temperature of the fuel in the pressurizing chamber. In addition, when the obtained pressurizing chamber temperature is higher than the threshold value, the fuel discharge amount by one discharge operation of the fuel pump increases. Therefore, the amount of fuel flowing through the pressurizing chamber by one discharge operation increases, and the cooling effect of the flowing fuel is improved. Therefore, generation of the air bubbles caused by the fuel vapor can be prevented.

According to a second aspect of the present disclosure, a fuel pump control device controls a fuel pump which repeatedly executes a discharge operation of pressurizing and discharging fuel in a pressurizing chamber with a pressurizing member. A holding container which holds the fuel discharged by the fuel pump in a pressurized state is connected to the fuel pump. The control device includes a discharge amount setting unit which sets a fuel discharge amount by one discharge operation of the fuel pump based on a holding pressure which is a pressure of the fuel in the holding container; and a discharge amount control unit which increases a fuel discharge amount by one discharge operation of the fuel pump when the discharge amount set by the discharge amount setting unit is smaller than a threshold value.

According to the above-described configuration, the discharge amount setting unit sets the fuel discharge amount by one discharge operation of the fuel pump based on the holding pressure that is the pressure of the fuel in the holding container. When the fuel discharge amount by one discharge operation of the fuel pump is small, the amount of fuel flowing through the pressurizing chamber by one discharge operation is reduced, and thus, the cooling effect of the flowing fuel is reduced. In addition, when the fuel vapor pressure increases above the pressure which acts on the fuel due to the temperature rise of the fuel, the fuel boils and the air bubbles are generated by the fuel vapor.

When the set discharge amount is smaller than the threshold value, the fuel discharge amount by one discharge operation of the fuel pump increases. Therefore, the amount of fuel flowing through the pressurizing chamber by one discharge operation increases, and the cooling effect of the flowing fuel is improved. Therefore, generation of the air bubbles caused by the fuel vapor can be prevented.

According to a third aspect of the present disclosure, there is provided a fuel pump control device which controls a fuel pump repeatedly executing a discharge operation of pressurizing and discharging fuel in a pressurizing chamber with a pressurizing member, in which a holding container, which holds the fuel discharged by the fuel pump in a pressurized state, is connected to the fuel pump, and in which the device includes: a discharge amount setting unit which sets a fuel discharge amount by one discharge operation of the fuel pump based on a holding pressure which is a pressure of the fuel in the holding container; and a discharge amount control unit which sets the fuel discharge amount by one discharge operation of the fuel pump to be larger than a predetermined amount regardless of the discharge amount set by the discharge amount setting unit when the discharge amount is smaller than a threshold value.

According to the above-described configuration, when the set discharge amount is smaller than the threshold value, regardless of the discharge amount set by the discharge amount setting unit, the fuel discharge amount by one discharge operation of the fuel pump is set to be larger than the predetermined amount. Therefore, the amount of fuel flowing through the pressurizing chamber by one discharge operation increases, and the cooling effect of the flowing fuel is improved. Therefore, generation of the air bubbles caused by the fuel vapor can be prevented.

According to a fourth aspect of the present disclosure, there is provided a fuel pump control device which controls a fuel pump repeatedly executing a discharge operation of pressurizing and discharging fuel in a pressurizing chamber with a pressurizing member, in which a holding container, which holds the fuel discharged by the fuel pump in a pressurized state, is connected to the fuel pump, and in which the device includes: a discharge amount setting unit which sets a fuel discharge amount by one discharge operation of the fuel pump based on a holding pressure which is a pressure of the fuel in the holding container; and a discharge amount control unit which sets the fuel discharge amount by one discharge operation of the fuel pump to be larger than a predetermined amount regardless of the discharge amount set by the discharge amount setting unit when the holding pressure is higher than a threshold value.

According to the above-described configuration, the discharge amount setting unit sets the fuel discharge amount by one discharge operation of the fuel pump based on the holding pressure that is the pressure of the fuel in the holding container. Here, when the holding pressure is high, since the pressure of the fuel in the pressurizing chamber increases, the amount of increase in fuel temperature due to pressurization increases. In addition, when the fuel vapor pressure increases above the pressure which acts on the fuel due to the temperature rise of the fuel, the fuel boils and the air bubbles are generated by the fuel vapor.

When the holding pressure is higher than the threshold value, regardless of the discharge amount set by the discharge amount setting unit, the fuel discharge amount by one discharge operation of the fuel pump is set to be larger than the predetermined amount. Therefore, the amount of fuel flowing through the pressurizing chamber by one discharge operation increases, and the cooling effect of the flowing fuel is improved. Therefore, generation of the air bubbles caused by the fuel vapor can be prevented.

BRIEF DESCRIPTION OF DRAWINGS

The above-described and other objects, features, or advantages of the present disclosure will become more apparent from the following detailed description with reference to the attached drawings.

DESCRIPTION OF EMBODIMENTS

Hereinafter, embodiments embodied in a fuel injection device of a four-cylinder gasoline engine (internal combustion engine) will be described with reference to the drawings.

First Embodiment

Figure 1:
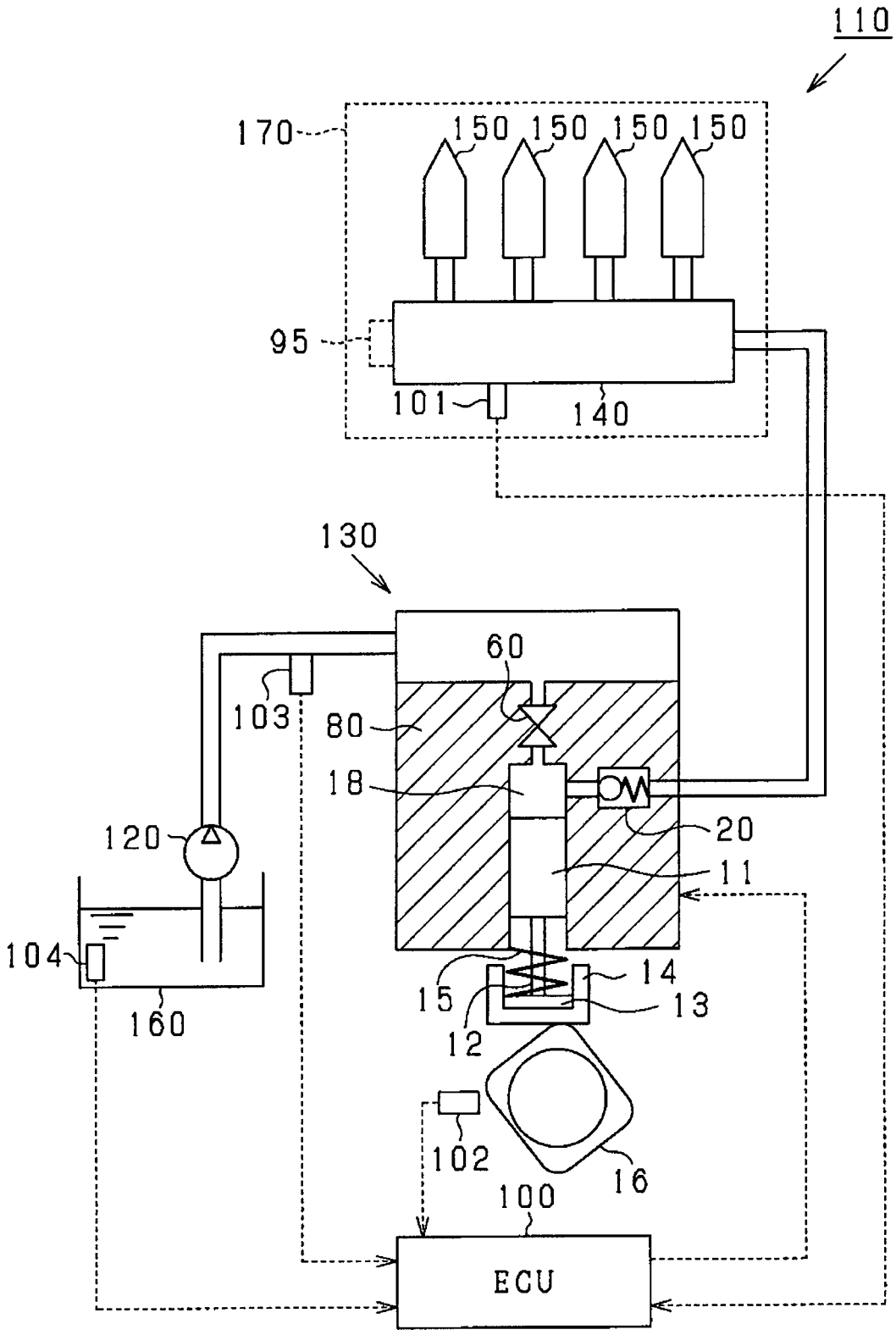
FIG. 1 is a schematic view illustrating a fuel injection device.

As illustrated in FIG. 1, a fuel injection device 110 is a cylinder injection type fuel injection device which directly injects fuel into a cylinder of a gasoline engine 170. The fuel injection device 110 includes a low-pressure fuel pump 120, a high-pressure fuel pump 130, a delivery pipe 140, a fuel injection valve 150, an ECU 100, and the like.

The low-pressure fuel pump 120 is an electric pump, pumps up the fuel in a fuel tank 160, and supplies the fuel to the high-pressure fuel pump 130. The high-pressure fuel pump 130 is a plunger pump having a plunger 11 or a pressurizing chamber 18. The high-pressure fuel pump 130 pressurizes the fuel supplied from the low-pressure fuel pump 120 in the pressurizing chamber 18 and supplies the pressurized fuel to the delivery pipe 140. The high-pressure fuel pump 130 is provided with a discharge valve 20 which opens when the pressure of the fuel pressurized in the pressurizing chamber 18 becomes equal to or higher than a predetermined pressure and supplies the high-pressure fuel to the delivery pipe 140.

The delivery pipe 140 (corresponding to a holding container) accumulates the fuel of which the pressure has increased by the high-pressure fuel pump 130. In other words, the delivery pipe 140 holds the fuel discharged by the high-pressure fuel pump 130 in a pressurized state. A fuel injection valve 150 which is provided for each cylinder of the engine 170 one by one, is connected to the delivery pipe 140. The fuel injection valve 150 injects the high-pressure fuel supplied from the delivery pipe 140 into a combustion chamber formed in each of the cylinders.

Figure 2:
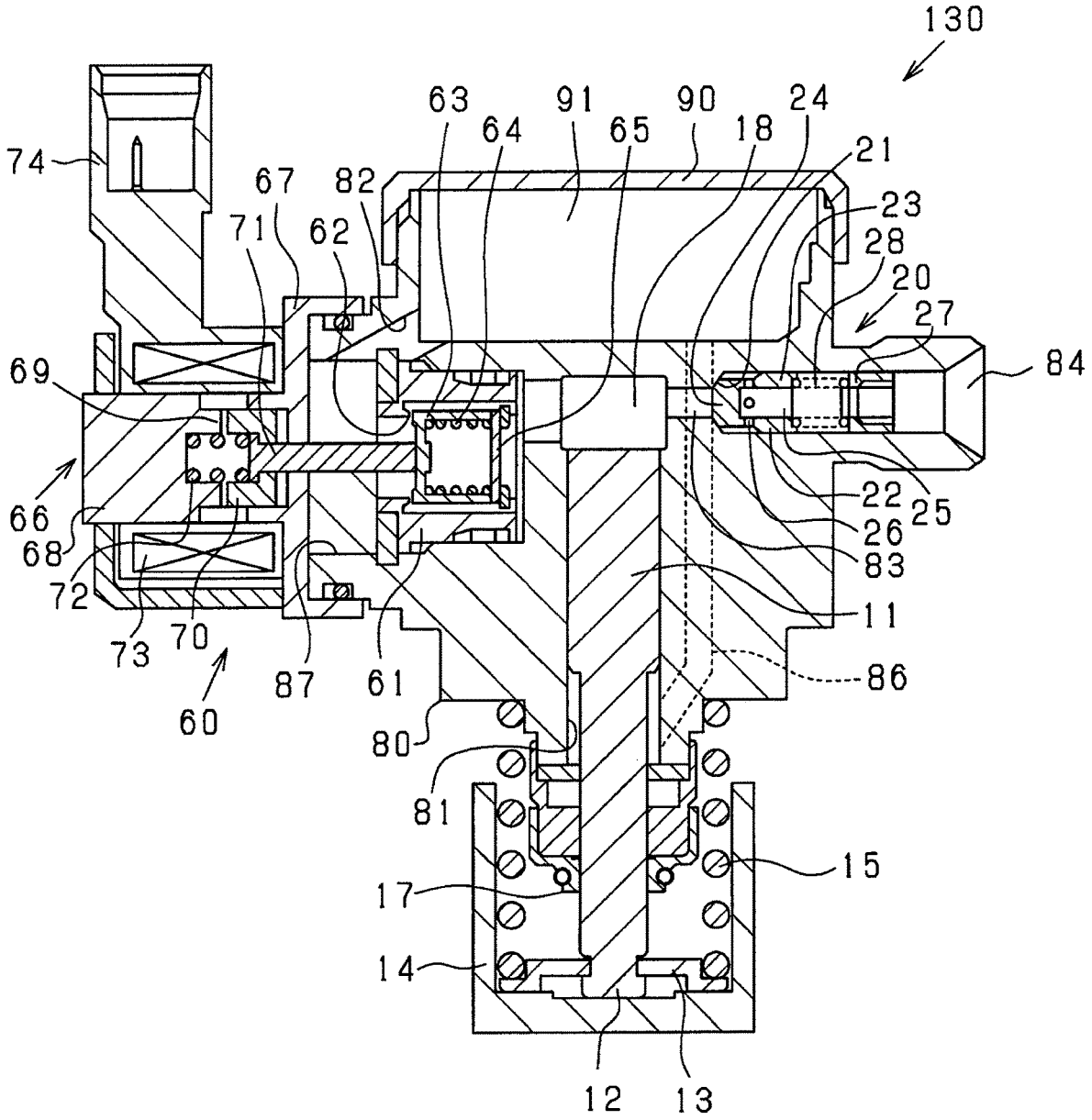
FIG. 2 is a sectional view of a high-pressure fuel pump of FIG. 1.

Next, the configuration of the high-pressure fuel pump 130 will be described in detail with reference to FIG. 2. The high-pressure fuel pump 130 includes a cylinder 80, a housing cover 90, a plunger 11, a metering valve 60, the discharge valve 20, and the like.

The cylinder 80 and the housing cover 90 configure a housing. The cylinder 80 is made of stainless steel or the like. The cylinder 80 supports the plunger 11 so as to reciprocate.

In addition, a pipe joint (not illustrated) and the metering valve 60 connected to the low-pressure fuel pump 120 are attached to a fuel inlet side of the cylinder 80, and the discharge valve 20 is attached to the fuel outlet side.

A suction passage 82, a pressurizing chamber 18, a discharge passage 83, a return passage 86, and the like are formed in the cylinder 80. Above the cylinder 80, a suction chamber 91 is formed between an upper end portion of the cylinder 80 and the housing cover 90. An outlet portion 84 is formed on the fuel outlet side of the discharge passage 83.

The suction passage 82 (corresponding to the supply passage) is a passage which connects the suction chamber 91 and the pressurizing chamber 18 to each other. The discharge passage 83 is a passage which connects the pressurizing chamber 18 and the outlet portion 84 to each other. The return passage 86 is a passage which connects a sliding portion 81 and the suction chamber 91 to each other.

The plunger 11 (corresponding to the pressurizing member) is supported by the sliding portion 81 of the cylinder 80 so as to be capable of reciprocating. The pressurizing chamber 18 is formed at one end side in a reciprocating direction of the plunger 11. The head 12 formed on the other end side of the plunger 11 is coupled to a spring seat 13. Between the spring seat 13 and the cylinder 80, a spring 15 is provided.

The spring seat 13 is pressed against an inner wall of a bottom portion of a tappet 14 by a biasing force of the spring 15. An outer wall of the bottom portion of the tappet 14 slides with a cam 16 by the rotation of the cam 16 (refer to FIG. 1), and accordingly the plunger 11 reciprocates.

An oil seal 17 is provided at an end portion of the sliding portion 81 on the side opposite to the pressurizing chamber 18. The oil seal 17 prevents oil from intruding into the pressurizing chamber 18 from the inside of the engine 170 and prevents fuel leakage from the pressurizing chamber 18 into the engine 170. Leaking fuel leaked from the sliding parts of the plunger 11 and the cylinder 80 toward the oil seal 17 side is returned from the return passage 86 to the suction chamber 91 on a low-pressure side. In other words, the return passage 86 returns the leaking fuel leaked from the pressurizing chamber 18 without being discharged in the discharge operation of the high-pressure fuel pump 130 to the suction passage 82. Accordingly, it is possible to prevent application of high fuel pressure to the oil seal 17.

The metering valve 60 includes a valve seat member 61, a valve member 63, a valve closing spring 64, a spring seat 65, an electromagnetic driving unit 66, and the like. The metering valve 60 is a valve for controlling the amount of fuel suctioned into the pressurizing chamber 18 from the suction chamber 91. The valve seat member 61, the valve member 63, the valve closing spring 64, and the spring seat 65 are accommodated in a housing hole 87 formed in the cylinder 80. The accommodation hole 87 is formed in the middle of the suction passage 82. The bottom portion of the accommodation hole 87 is connected to the suction passage 82 on the pressurizing chamber 18 side, and a side wall of the accommodation hole 87 is connected to the suction passage 82 on the suction chamber 91 side.

The valve seat member 61 is formed in a cylindrical shape and is supported on the side wall of the accommodation hole 87. The valve seat member 61 has a valve seat 62 on which the valve member 63 is seated on an inner circumferential wall. The valve member 63 is formed in a bottomed cylindrical shape, and the outer wall of the bottom portion is accommodated in the valve seat member 61 so as to be seated on the valve seat 62. On the inner circumferential wall side of the valve member 63, the valve closing spring 64 is accommodated.

One end portion of the valve closing spring 64 is supported by the spring seat 65 attached to the valve seat member 61 and the other end portion thereof is supported by the inner wall of the bottom portion of the valve member 63. The valve member 63 is pressed in a direction of being seated on the valve seat 62 by the biasing force of the valve closing spring 64. When the valve member 63 is seated on the valve seat 62, communication between the suction chamber 91 and the pressurizing chamber 18 is blocked.

The electromagnetic driving unit 66 includes a body 67, a fixed core 68, a movable core 70, a pin 71, a valve opening spring 72, a coil 73, a connector 74, and the like.

The body 67 covers an opening portion of the accommodation hole 87 and supports the fixed core 68 formed of a magnetic material. The fixed core 68 has an attracting portion 69.

The movable core 70 is formed of a magnetic material and is provided on the attracting portion 69 side of the fixed core 68. The movable core 70 is linked to a pin 71 provided so as to penetrate the body 67. The attracting portion 69 generates a magnetic attractive force for attracting the movable core 70 with the movable core 70. The pin 71 reciprocates together with the movable core 70, and moves the valve member 63 in the direction of releasing and seating.

Between the fixed core 68 and the movable core 70, the valve opening spring 72 is provided. The biasing force of the valve opening spring 72 is greater than the biasing force of the valve closing spring 64. Therefore, when no magnetic attractive force is generated in the attracting portion 69, the movable core 70 moves in a direction of being separated from the fixed core 68. In other words, the valve member 63 moves in a direction of releasing and seating from the valve seat 62. As a result, the suction chamber 91 and the pressurizing chamber 18 communicate with each other. In other words, the metering valve 60 is a normally open type valve.

The coil 73 is provided on the outer circumferential side of the fixed core 68. On the outer circumferential side of the coil 73, a connector 74 for supplying electric power to the coil 73 is provided. When the electric power is supplied to the coil 73 from the outside, a magnetic flux which passes through the fixed core 68 and the movable core 70 is generated, and the magnetic attractive force acts between the attracting portion 69 and the movable core 70. The movable core 70 moves toward the fixed core 68 side due to the generation of the magnetic attractive force and the valve seat 62 is seated on the valve member 63. As a result, the communication between the suction chamber 91 and the pressurizing chamber 18 is blocked.

The discharge valve 20 includes a valve seat 21, a valve body 22, a stopper 27, and a spring 28, and is accommodated in the discharge passage 83. The valve seat 21 is formed on the inner wall of the discharge passage 83. The valve body 22 is formed in a substantially cylindrical shape and is provided on the outlet portion 84 side of the valve seat 21. The valve body 22 has a large diameter portion 23 and a small diameter portion 24. The large diameter portion 23 is slidably supported in the discharge passage 83. The small diameter portion 24 is provided closer to the pressurizing chamber 18 side than the large diameter portion 23, the valve body 22 moves toward the pressurizing chamber 18 side, and accordingly, a tip end of the small diameter portion 24 is seated on the valve seat 21.

Multiple through-holes 26 which communicate with the fuel passage 25 formed on the inside of the valve body 22 are formed on the side wall of the small diameter portion 24. Accordingly, when the valve body 22 is separated from the valve seat 21, the fuel which flows into a gap between the small diameter portion 24 and the discharge passage 83 passes through the through-hole 26, flows into the fuel passage 25, and flows toward the outlet portion 84.

The stopper 27 is formed in a substantially cylindrical shape and is provided closer to the outlet portion 84 side than the valve body 22. The stopper 27 is fixed to the discharge passage 83 and regulates the movement of the valve body 22 toward the outlet portion 84 side. The spring 28 is provided between the stopper 27 and the large diameter portion 23 of the valve body 22. The spring 28 biases the stopper 27 and the valve body 22 to pull apart. Accordingly, the small diameter portion 24 of the valve body 22 is seated on the valve seat 21, and communication between the pressurizing chamber 18 and the outlet portion 84 is blocked.

When a differential pressure is generated between the pressurizing chamber 18 side and the outlet portion 84 side of the valve body 22 and the force which acts on the tip end of the small diameter portion 24 of the valve body 22 exceeds the biasing force of the spring 28, the valve body 22 is released from the valve seat 21, and the pressurizing chamber 18 and the outlet portion 84 communicate with each other.

Next, the operation of the high-pressure fuel pump 130 will be described.

(1) Suction Stroke

When the plunger 11 descends, no electric power is supplied to the coil 73 of the metering valve 60. When the plunger 11 descends, the fuel pressure in the pressurizing chamber 18 decreases, and the fuel in the suction chamber 91 is suctioned into the pressurizing chamber 18 via the suction passage 82. Energization of the metering valve 60 to the coil 73 is in a state of being turned off until the plunger 11 reaches the bottom dead center.

(2) Return Stroke

Even when the plunger 11 rises from the bottom dead center toward the top dead center, the energization to the coil 73 is in the off state. Therefore, the fuel in the pressurizing chamber 18 returns to the suction chamber 91 via the metering valve 60.

(3) Pressurizing Stroke

When energizing the coil 73 is turned on during the returning stroke, the magnetic attractive force is generated in the attracting portion 69 of the fixed core 68, and the movable core 70 and the pin 71 are attracted to the attracting portion 69. As a result, the valve member 63 is seated on the valve seat 62, the communication between the pressurizing chamber 18 and the suction chamber 91 is blocked, and the flow of fuel from the pressurizing chamber 18 to the suction chamber 91 is stopped.

In this state, when the plunger 11 further rises toward the top dead center, the fuel in the pressurizing chamber 18 is pressurized and the fuel pressure rises. In addition, when the fuel pressure in the pressurizing chamber 18 becomes equal to or higher than the predetermined pressure, the valve body 22 is separated from the valve seat 21 against the biasing force of the spring 28, and the discharge valve 20 is opened. Accordingly, the fuel pressurized in the pressurizing chamber 18 is discharged from the outlet portion 84. The fuel discharged from the outlet portion 84 is supplied to the delivery pipe 140 illustrated in FIG. 1.

By repeating the above-described strokes (1) to (3), the high-pressure fuel pump 130 pressurizes and discharges the suctioned fuel. The discharge amount of the fuel is regulated by controlling the energization of the metering valve 60 timing to the coil 73.

The ECU 100 includes a CPU, a RAM, a ROM, a driving circuit for energizing and driving the fuel injection valve 150, a driving circuit for energizing and driving the fuel pumps 120 and 130, and the like. In the ROM, a graph (FIG. 8) illustrating the relationship between the temperature of the fuel and the vapor pressure which will be described later, a map (FIGS. 5 and 9) illustrating the relationship of a discharge amount Q, a rail pressure Pc, a temperature rise amount ΔTp, and a pump rotation speed Np, and the like are stored. Detection signals of a rail pressure sensor 101, a cam angle sensor 102, a feed pressure sensor 103, a fuel temperature sensor 104 and the like are input into the ECU 100.

The rail pressure sensor 101 (corresponding to a holding pressure obtaining unit and a holding pressure detection unit) detects the rail pressure Pc (corresponding to a holding pressure), which is the fuel pressure in the delivery pipe 140. The cam angle sensor 102 detects the angle of the cam shaft that rotates the cam 16. The feed pressure sensor 103 (corresponding to the supply pressure obtaining unit) detects a feed pressure Pf which is a pressure of the fuel supplied to the high-pressure fuel pump 130. The fuel temperature sensor 104 (corresponding to a supply temperature obtaining unit) is provided in the fuel tank 160 and detects a supply temperature Tin which is a temperature of the fuel supplied to the high-pressure fuel pump 130.

The ECU 100 calculates the pump rotation speed Np (corresponding to the speed of the discharge operation) of the high-pressure fuel pump 130 based on the detection signal of the cam angle sensor 102. The ECU 100 controls the fuel discharge amount by the high-pressure fuel pump 130, a state of the fuel injection by the fuel injection valve 150, and the like, based on the detection signals of the sensors 101 to 104. In addition, the ECU 100, the rail pressure sensor 101, the cam angle sensor 102, the feed pressure sensor 103, and the fuel temperature sensor 104 configure a control device of the fuel pump.

Here, the high-pressure fuel pump 130 repeatedly executes the discharge operation of pressurizing and discharging the fuel in the pressurizing chamber 18 by the plunger 11. When the fuel in the pressurizing chamber 18 is pressurized by the plunger 11, the temperature of the pressurized fuel increases. In addition, when the fuel vapor pressure increases above the pressure which acts on the fuel due to the temperature rise of the fuel suctioned into the pressurizing chamber 18, the fuel boils and the air bubbles are generated by the fuel vapor.

Figure 8:
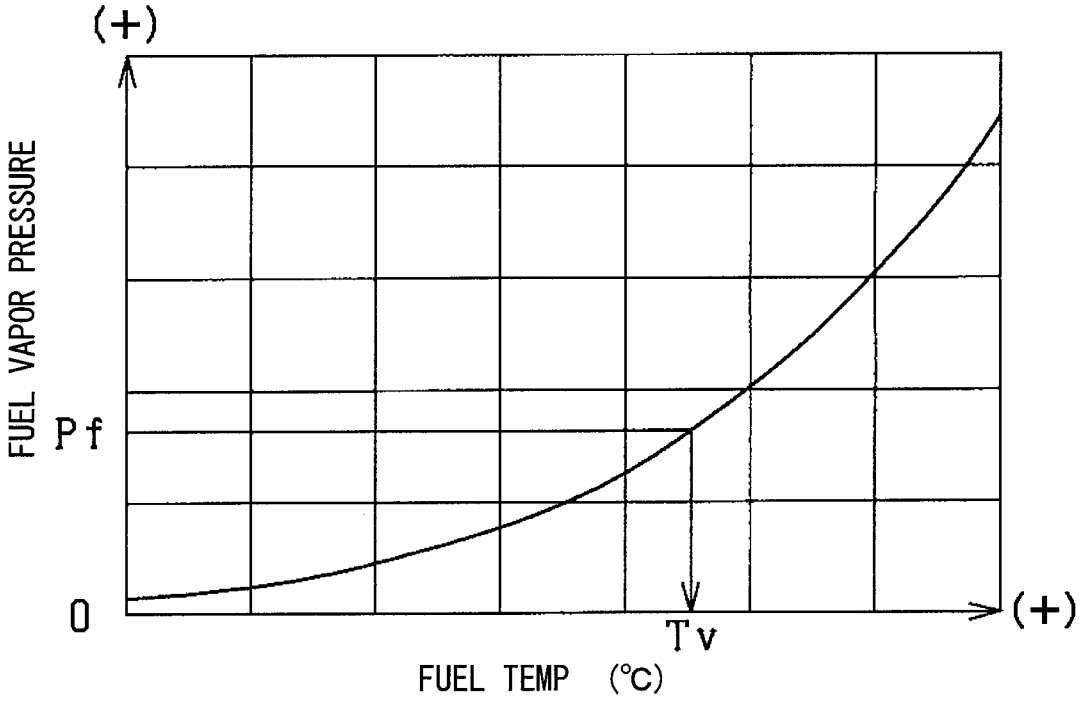
FIG. 8 is a graph illustrating a relationship between a temperature of fuel and a vapor pressure.

FIG. 8 is a graph illustrating a relationship between a temperature of fuel and a vapor pressure. As illustrated in the drawing, the higher the temperature of the fuel is, the higher the fuel vapor pressure increases. In addition, when the temperature of the fuel becomes higher than a temperature Tv and the fuel vapor pressure becomes higher than the feed pressure Pf which acts on the fuel, the fuel boils and air bubbles caused by the fuel vapor are generated. Hereinafter, the temperature of the fuel at this time is referred to as an air bubble generation temperature Tv. The air bubble generation temperature Tv varies in accordance with the feed pressure Pf.

Figure 3:
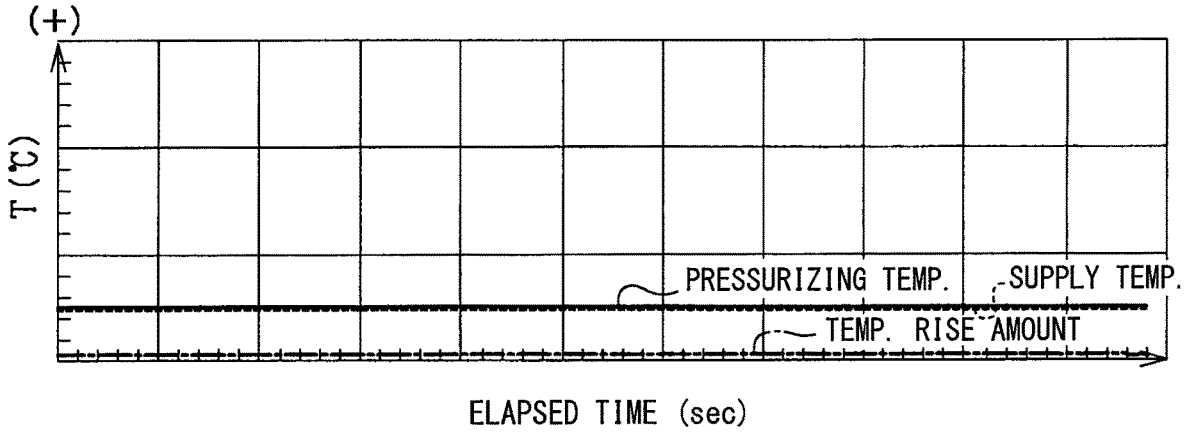
FIG. 3 is a graph illustrating a temporal change in supply temperature, pressurizing chamber temperature, and temperature rise amount at a time of low rail pressure.

FIG. 3 is a graph illustrating a temporal change in supply temperature Tin, pressurizing chamber temperature Tp, and temperature rise amount ΔTp at a time of low rail pressure (for example, 5 MPa). As indicated by the broken line in the drawing, the temperature (supply temperature Tin) of the fuel supplied to the high-pressure fuel pump 130 is substantially constant. As indicated by the solid line, the temperature of the fuel in the pressurizing chamber 18 (pressurizing chamber temperature Tp) is also substantially constant. Therefore, the temperature rise amount ΔTp obtained by subtracting the supply temperature Tin from the pressurizing chamber temperature Tp is also substantially constant.

Figure 4:
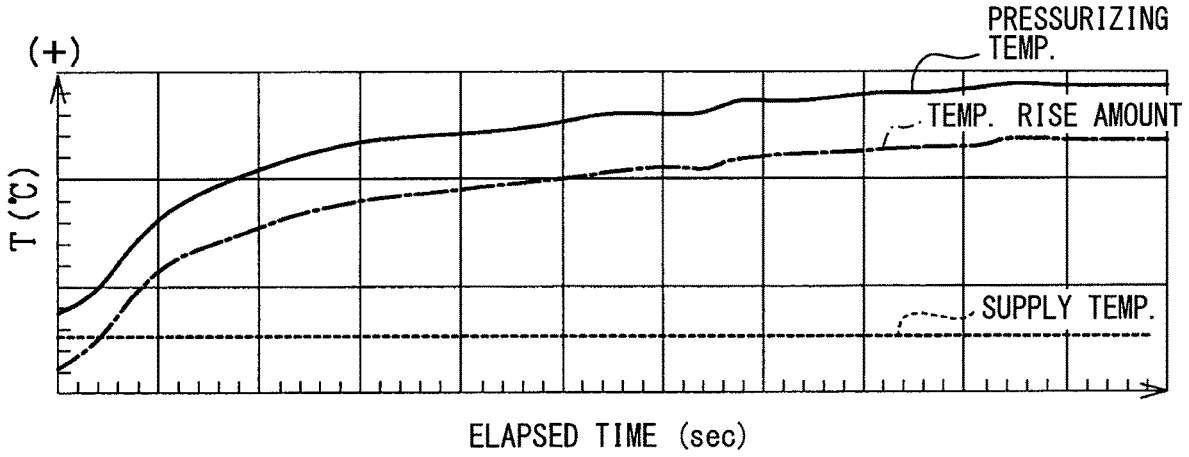
FIG. 4 is a graph illustrating a temporal change in supply temperature, pressurizing chamber temperature, and temperature rise amount at a time of high rail pressure.

FIG. 4 is a graph illustrating a temporal change in supply temperature Tin, pressurizing chamber temperature Tp, and temperature rise amount ΔTp at a time of high rail pressure (for example, 100 MPa). As indicated by the broken line in the drawing, the supply temperature Tin is substantially constant. As indicated by the solid line, the pressurizing chamber temperature Tp rises with the lapse of time. Therefore, the temperature rise amount ΔTp obtained by subtracting the supply temperature Tin from the pressurizing chamber temperature ΔTp also rises with the lapse of time. One reason thereof is that, when the rail pressure Pc is high, since the pressure of the fuel in the pressurizing chamber 18 increases, the amount of increase in fuel temperature due to pressurization increases.

Furthermore, the leaking fuel leaked from the pressurizing chamber 18 without being discharged in the discharge operation of the high-pressure fuel pump 130 is returned to the suction passage 82 (suction chamber 91) for supplying the fuel to the pressurizing chamber 18 by the return passage 86. Therefore, the fuel of which the temperature is pressurized and increases is supplied to the pressurizing chamber 18, and the temperature of the fuel in the pressurizing chamber 18 is more likely to rise.

More specifically, a gap of usually several μm is provided between the outer circumferential surface of the plunger 11 and the inner circumferential surface of the pressurizing chamber 18. Therefore, when the fuel in the pressurizing chamber 18 is pressurized by the plunger 11, a part of the fuel leaks from the gap. The temperature of the fuel leaked from the gap from the high-pressure compressed state becomes high. When the high temperature leak fuel is mixed with the supplied fuel, the temperature of the supplied fuel slightly rises. When the supplied fuel of which the temperature slightly rises is suctioned into the pressurizing chamber 18 and pressurized, a leaking fuel of which the temperature further rises is generated. When the leaking fuel is mixed with the supplied fuel, the temperature of the supplied fuel further rises. In this manner, when the high-pressure fuel pump 130 is continuously operated under certain operating conditions, the temperature of the fuel supplied to the pressurizing chamber 18 increases for each discharge operation.

Here, when the temperature rises, the fuel temperature equilibrates at a certain value due to the balance with the amount of heat radiation, such as the heat exchange between the outer surface of the high-pressure fuel pump 130 and the outside air. When the operation of the high-pressure fuel pump 130 is continued under the same operating condition, as illustrated in FIG. 4, the fuel temperature supplied to the pressurizing chamber 18 gradually rises, reaches a certain constant temperature after a certain period of time, and does not rise any more.

In addition, when a fuel discharge amount Q due to one discharge operation of the high-pressure fuel pump 130, specifically, the single ascending operation of the plunger 11 is small, the amount of fuel flowing through the pressurizing chamber 18 becomes small by one discharge operation. Therefore, a cooling effect of the flowing fuel is reduced.

A discharge flow rate of the high-pressure fuel pump 130 is a supply flow rate to the high-pressure fuel pump 130 and is a replacement amount of the fuel on the inside of the high-pressure fuel pump 130. Therefore, under operating conditions in which the high-pressure fuel pump 130 is discharging with a high flow rate, even when the high temperature leaking fuel is generated on the inside of the high-pressure fuel pump 130 and mixed with the supplied fuel, the ratio of the leakage amount to the replacement amount becomes small. Therefore, the temperature of the fuel supplied to the pressurizing chamber 18 does not rise excessively, and the fuel does not become air bubbles. Meanwhile, under the operating condition in which the high-pressure fuel pump 130 is discharging at a low flow rate, the ratio of the leakage amount to the replacement amount increases, and the temperature of the fuel supplied to the pressurizing chamber 18 excessively rises.

Figure 5:
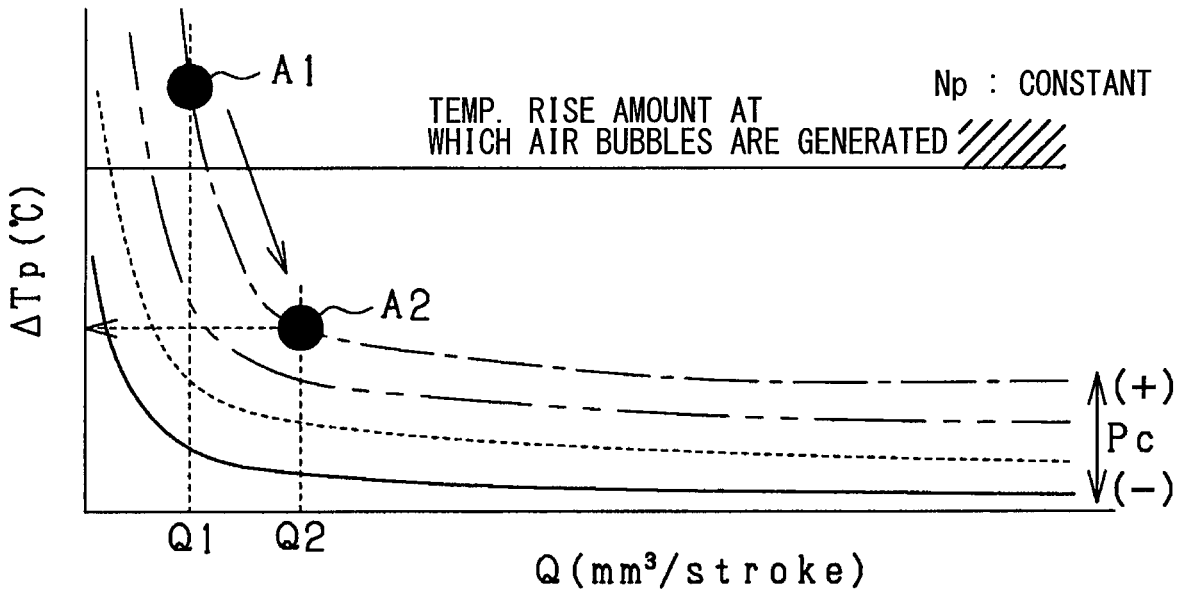
FIG. 5 is a map illustrating the relationship of a discharge amount, a rail pressure, and the temperature rise amount.

FIG. 5 is a map illustrating the relationship of the fuel discharge amount Q, the rail pressure Pc, and the temperature rise amount ΔTp by one discharge operation of the high-pressure fuel pump 130 at a constant pump rotation speed Np. The temperature rise amount ΔTp is a temperature rise amount at equilibrium after a certain period of time. As illustrated in the drawing, since the higher the rail pressure Pc is, the higher the temperature of the leaking fuel increases, the temperature rise amount ΔTp increases. Further, since the smaller the discharge amount Q is, the higher the ratio of the leakage amount to the replacement amount increases, the temperature rise amount ΔTp becomes larger. In addition, when the feed pressure Pf and the supply temperature Tin are constant, when the temperature rise amount ΔTp exceeds the temperature rise amount at which the air bubbles are generated, the air bubbles caused by the fuel vapor are generated. When the rail pressure Pc is lower than the predetermined pressure, the temperature rise amount ΔTp does not exceed the temperature rise amount at which the air bubbles are generated, and the air bubbles caused by the fuel vapor are not generated. Further, the smaller the discharge amount Q is, the larger the temperature rise amount ΔTp becomes. When the discharge amount Q is larger than the predetermined amount, the temperature rise amount ΔTp does not exceed the temperature rise amount at which the air bubbles are generated, and the air bubbles caused by the fuel vapor are not generated.

Here, in the present embodiment, the pressurizing chamber temperature Tp which is the temperature of the fuel in the pressurizing chamber 18 is obtained, and when the obtained pressurizing chamber temperature Tp is higher than the threshold value, the fuel discharge amount Q by one discharge operation of the high-pressure fuel pump 130 increases. For example, in FIG. 5, when a state is a point A1, the state is moved to a state of a point A2, and a discharge amount Q1 increases to the discharge amount Q2. Accordingly, since the ratio of the leakage amount to the fuel replacement amount on the inside of the high-pressure fuel pump 130 is reduced, it is possible to prevent the temperature of the fuel supplied to the pressurizing chamber 18 from excessively increasing. As illustrated in FIG. 8, the threshold value is set to the air bubble generation temperature Tv at which the fuel vapor pressure becomes the feed pressure Pf. In addition, in consideration of the detection error or the like of the sensor used for control, the threshold value may be set to a temperature obtained by subtracting the predetermined temperature from the air bubble generation temperature Tv.

Figure 6:
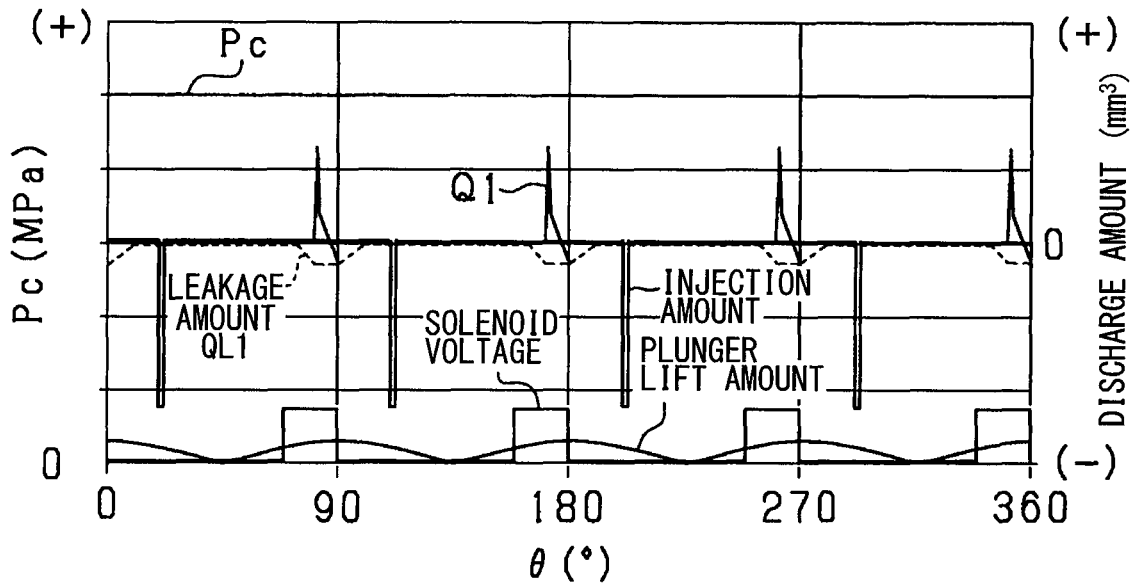
FIG. 6 is a time chart illustrating a discharge amount, a leakage amount, an injection amount, and the like before the discharge amount increases.

FIG. 6 is a time chart illustrating the discharge amount Q1, a leakage amount QL1, an injection amount, and the like before the discharge amount Q increases. As illustrated in the drawing, the fuel injection is executed once for one discharge operation of the high-pressure fuel pump 130 before the discharge amount Q increases (normal operation). In the discharge operation, the leakage amount QL1 is generated with respect to the discharge amount Q1. Leakage fuel occurs not only during the period when the fuel is being discharged, but also during the period when the fuel is compressed and pressurized. In addition, the leaking fuel is generated during a period in which the fuel pressure in the pressurizing chamber 18 is higher than the fuel pressure in the leakage space even during a period when the plunger 11 descends passing through the top dead center. Therefore, even when the discharge amount Q becomes infinitely small, a certain amount of leakage occurs as long as the fuel is compressed. In other words, when the fuel is not compressed, that is, only under the operating condition in which all of the fuel in the pressurizing chamber 18 is returned to the suction chamber 91 without energizing the coil 73, the leaking fuel is not generated. The leakage fuel is supplied to the pressurizing chamber 18 through the return passage 86, the suction chamber 91, and the suction passage 82.

When the fuel discharge amount Q by one discharge operation of the high-pressure fuel pump 130 increases, the fuel discharge amount discharged in a predetermined period by the high-pressure fuel pump 130 increases. Therefore, in the present embodiment, when increasing the fuel discharge amount Q, the number of times of discharge operations in the predetermined period of the high-pressure fuel pump 130 is reduced.

Figure 7:
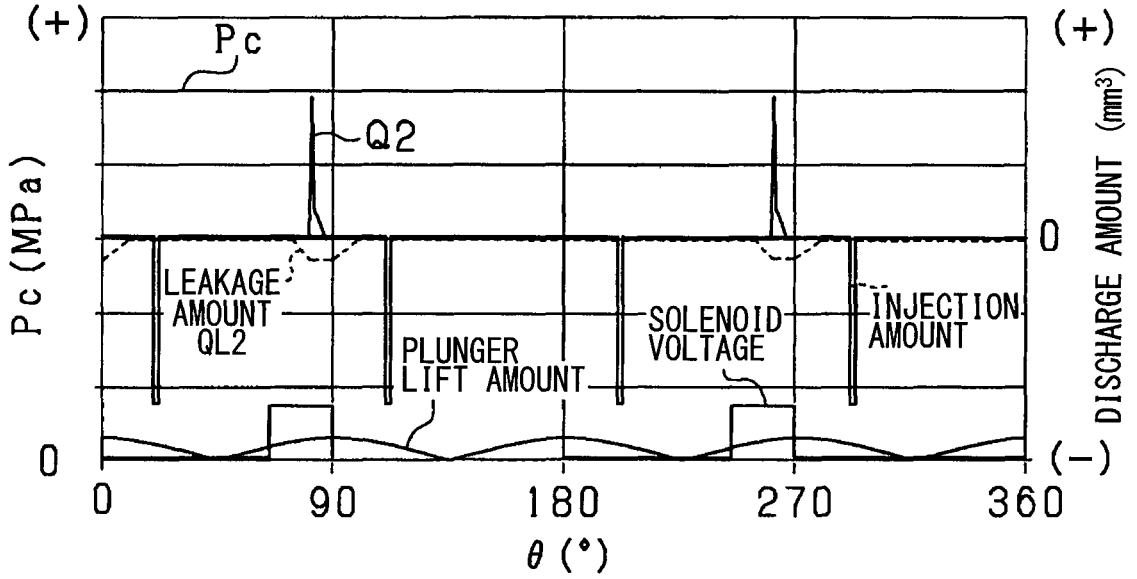
FIG. 7 is a time chart illustrating a discharge amount, a leakage amount, an injection amount, and the like after the discharge amount increases.

FIG. 7 is a time chart illustrating the discharge amount Q2, a leakage amount QL2, the injection amount, and the like after the discharge amount Q increases to two times Q1. As illustrated in the drawing, after the discharge amount Q increases (operation at the time of increasing), for example, fuel injection is executed twice for one discharge operation of the high-pressure fuel pump 130. In this case, in the discharge operation, the leakage amount QL2 is also generated with respect to the discharge amount Q2. Since the discharge period is long compared to FIG. 6, QL2>QL1 is satisfied, but QL2/QL1<2 since there is a certain leakage amount during a period other than the discharge period. Therefore, the ratio of the leakage amount to the discharge amount is QL1/Q1>QL2/Q2. In other words, when the discharge amount increases, the ratio of the leakage amount to the replacement amount becomes smaller, and the temperature rise of the fuel supplied to the pressurizing chamber 18 is prevented.

Figure 9:
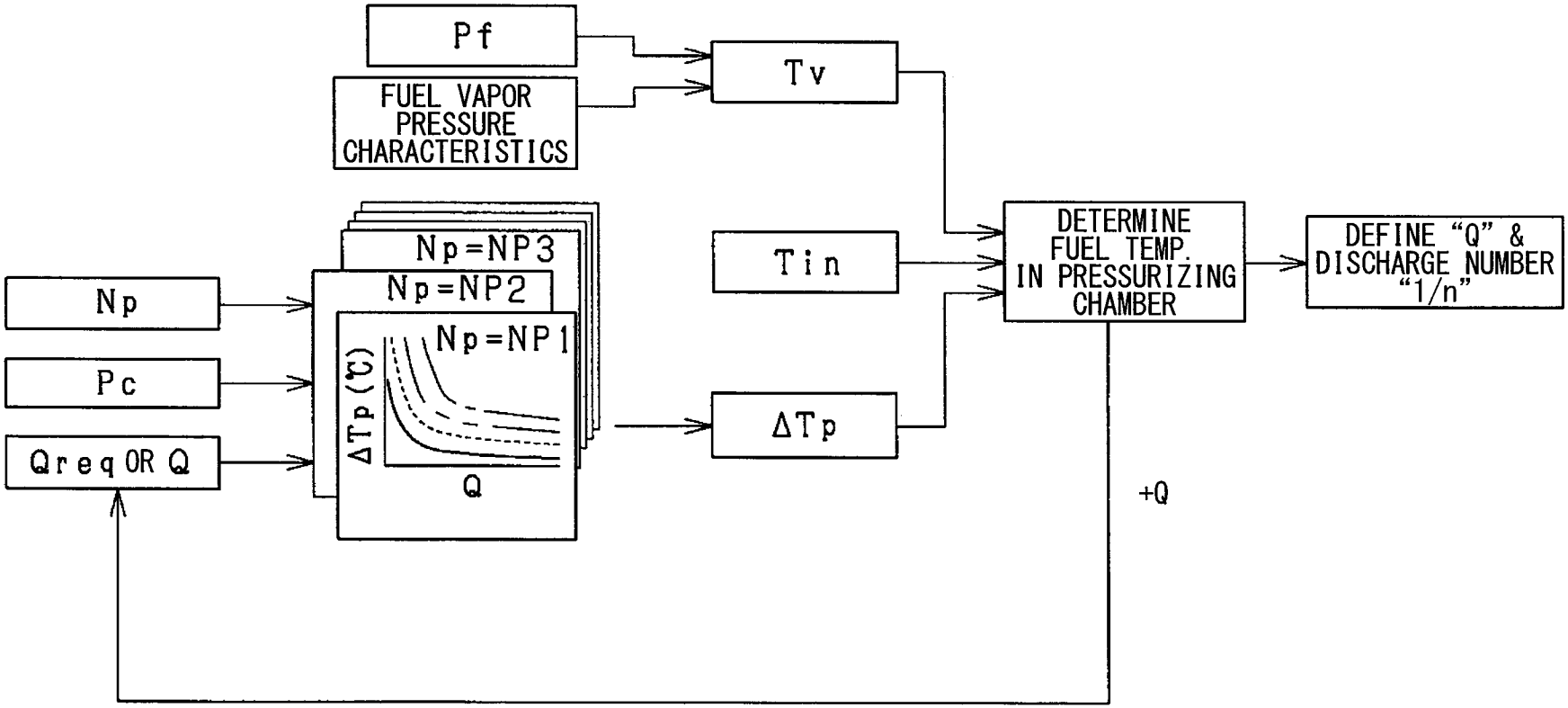
FIG. 9 is a block diagram illustrating an outline of fuel pump control according to a first embodiment.

FIG. 9 is a block diagram illustrating an outline of fuel pump control according to the present embodiment. The control is executed by the ECU 100.

The air bubble generation temperature Tv is calculated based on the feed pressure Pf detected by the feed pressure sensor 103 and the vapor pressure characteristics of the fuel stored in the ROM (graph of FIG. 8). Specifically, the temperature of the fuel at which the feed pressure Pf and the fuel vapor pressure are identical to each other is calculated as the air bubble generation temperature Tv.

Figure 10:
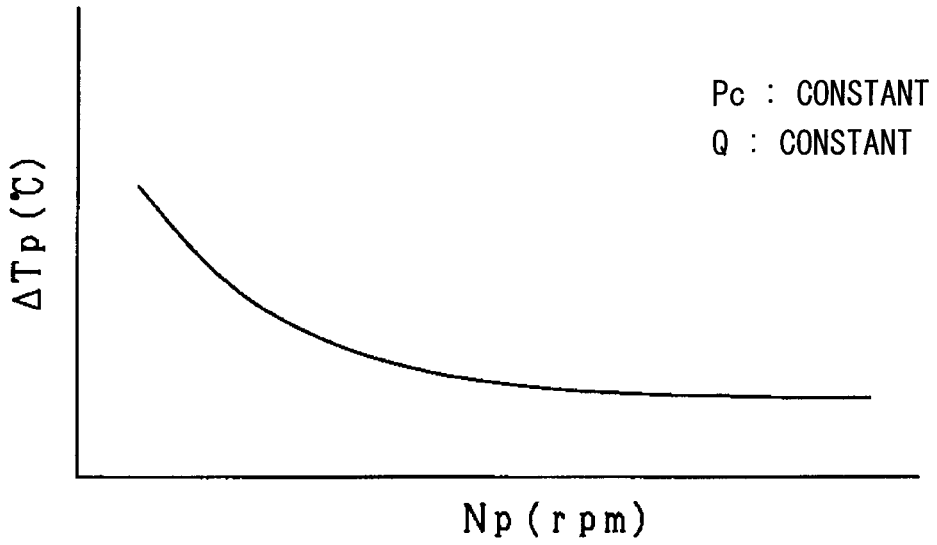
FIG. 10 is a graph illustrating the relationship between a pump rotation speed and the temperature rise amount.

Further, by applying the pump rotation speed Np calculated based on the detection signal of the cam angle sensor 102, the rail pressure Pc detected by the rail pressure sensor 101, and the discharge amount Q to the map, the temperature rise amount ΔTp of the fuel in the pressurizing chamber 18 is calculated. Here, when the rail pressure Pc and the discharge amount Q are constant, the lower the rotation speed Np is, the larger the temperature rise amount ΔTp increases (FIG. 10). This is because, since the lower the rotation speed Np is, the longer the pressurization and discharge time increases, the leakage amount increases even with the same rail pressure Pc and the discharge amount Q. Therefore, for each rotation speed Np, the relationship illustrated in FIG. 5 is recorded in the ROM as a map. Otherwise, a map at several rotation speeds Np may be recorded, and at the rotation speed Np which is not recorded as the map, interpolation calculation or the like may be performed from the relationship of FIG. 10 from the map of one certain rotation speed Np which is recorded. The initial value of the discharge amount Q is a required discharge amount Qreq. The required discharge amount Qreq is calculated based on the rail pressure Pc, a target rail pressure Pct, and the fuel injection amount by the fuel injection valve 150.

In addition, it is determined whether or not the pressurizing chamber temperature Tp obtained by adding the temperature rise amount ΔTp to the supply temperature Tin detected by the fuel temperature sensor 104 is higher than the air bubble generation temperature Tv. When it is determined that the pressurizing chamber temperature Tp is higher than the air bubble generation temperature Tv, the discharge amount Q increases. More specifically, an increase ratio "n" of the discharge amount Q increases from "1" of the initial value by "1", and the discharge amount Q is calculated by multiplying the increase ratio "n" by the required discharge amount Qreq. At the same time, the number of times of discharge operations is 1/n times the discharge amount Q before the discharge amount Q increases, corresponding to multiplying the ejection amount Q by one discharge operation by "n". However, the discharge amount Q is set within a range that does not exceed the maximum discharge amount that can be discharged by the high-pressure fuel pump 130. In addition, the pressurizing chamber temperature Tp is calculated again for the increased discharge amount Q, and it is determined whether or not the pressurizing chamber temperature Tp is higher than the air bubble generation temperature Tv.

Meanwhile, when it is determined that the pressurizing chamber temperature Tp is not higher than the air bubble generating temperature Tv, it is confirmed to discharge the discharge amount Q (n×Qreq) at that time with the number of times of discharge operations of 1/n times. Thereafter, the high-pressure fuel pump 130 is operated in the confirmed operating state.

Figure 11:
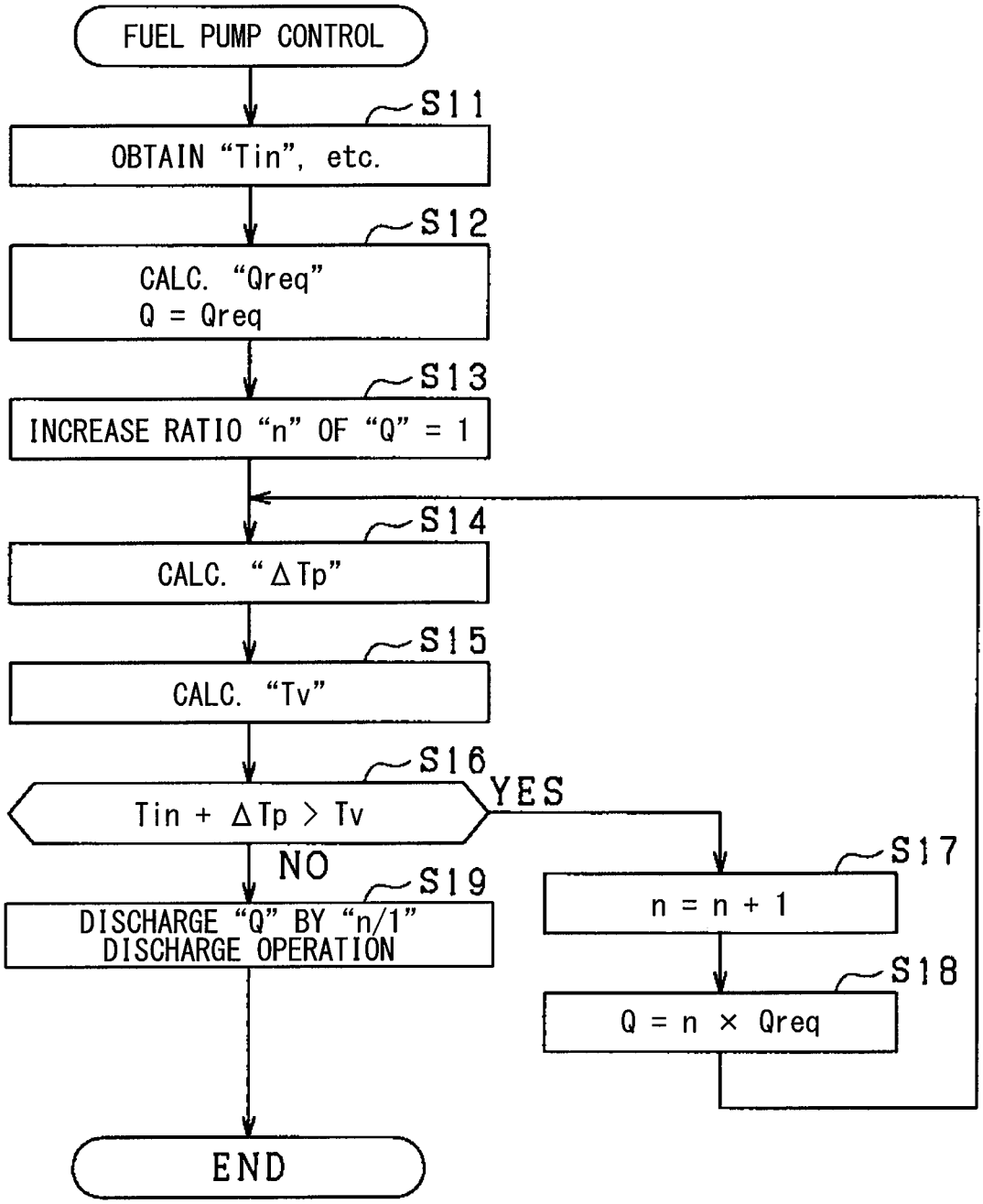
FIG. 11 is a flowchart illustrating a procedure of the fuel pump control of FIG. 9.

FIG. 11 is a flowchart illustrating a procedure of the fuel pump control of FIG. 9. This series of processing is executed by the ECU 100.

First, the supply temperature Tin, the feed pressure Pf, the pump rotation speed Np, the rail pressure Pc and the like of the fuel are obtained (S11). Subsequently, the required discharge amount Qreq to the high-pressure fuel pump 130 is calculated from the target rail pressure Pct or the like, and the initial value of the discharge amount Q is set as the required discharge amount Qreq (S12). The increase ratio "n" of the discharge amount Q is set to "1" of the initial value (S13).

Subsequently, based on the discharge amount Q, the pump rotation speed Np, the rail pressure Pc, and the map, the temperature rise amount ΔTp of the fuel in the pressurizing chamber 18 is calculated (S14). Based on the feed pressure Pf and the vapor pressure characteristics of the fuel, the air bubble generation temperature Tv is calculated (S15).

Next, it is determined whether or not the pressurizing chamber temperature Tp obtained by adding the temperature rise amount ΔTp to the supply temperature Tin is higher than the air bubble generation temperature Tv (S16). In the determination, when it is determined that the pressurizing chamber temperature Tp is higher than the air bubble generation temperature Tv (S16: YES), "1" is added to the increase ratio "n" of the injection amount (S17).

Subsequently, the required discharge amount Qreq is multiplied by the increase ratio "n", so that the discharge amount Q is calculated (S18). Thereafter, based on the calculated discharge amount Q, the process from S14 is executed again.

Meanwhile, in the determination of S16, when it is determined that the pressurizing chamber temperature Tp is not higher than the air bubble generation temperature Tv (S16: NO), the high-pressure fuel pump 130 is operated to discharge the discharge amount Q (n×Qreq) at that time with the number of times of discharge operations of 1/n times (S19). Thereafter, the series of processing ends (END).

In addition, the processing of S11 and S14 corresponds to the processing as the pressurizing chamber temperature obtaining unit and the processing of S16 to S18 corresponds to the processing as the discharge amount control unit.

The present embodiment described in detail above has the following advantages.

The pressurizing chamber temperature Tp which is the temperature of the fuel in the pressurizing chamber 18 is calculated. In addition, when the obtained pressurizing chamber temperature Tp is higher than the threshold value, the fuel discharge amount Q by one discharge operation of the high-pressure fuel pump 130 increases. Therefore, the amount of fuel flowing through the pressurizing chamber 18 by one discharge operation increases, and the cooling effect of the flowing fuel is improved. Furthermore, since the ratio of the leakage amount to the fuel replacement amount on the inside of the high-pressure fuel pump 130 is reduced, there is no case where the temperature of the fuel supplied to the pressurizing chamber 18 excessively increases. Therefore, generation of the air bubbles caused by the fuel vapor can be prevented.

The feed pressure sensor 103 obtains the feed pressure Pf which is the pressure of the fuel supplied to the high-pressure fuel pump 130. In addition, the threshold value of the fuel temperature is set based on the air bubble generation temperature Tv at which the fuel vapor pressure becomes the feed pressure Pf obtained by the feed pressure sensor 103. Therefore, when the fuel vapor pressure rises above the pressure which acts on the fuel, it is possible to execute control to appropriately lower the fuel temperature.

A space where the temperature sensor and the like are disposed is limited around the pressurizing chamber 18, and it is difficult to directly detect the temperature of the fuel in the pressurizing chamber 18 with the temperature sensor or the like. In this regard, based on the supply temperature Tin obtained by the fuel temperature sensor 104 provided in the fuel tank 160, the rail pressure Pc obtained by the rail pressure sensor 101, the pump rotation speed Np, and the fuel discharge amount Q by one discharge operation of the high-pressure fuel pump 130, the pressurizing chamber temperature Tp is calculated. Therefore, even without directly detecting the temperature of the fuel in the pressurizing chamber 18, which is difficult to detect, the pressurizing chamber temperature Tp can be appropriately obtained.

The leaking fuel which is fuel leaked from the pressurizing chamber 18 without being discharged in the discharge operation is returned to the suction passage 82 for supplying the fuel to the pressurizing chamber 18 by the return passage 86. Therefore, the fuel which is leaked from the high-pressure state and of which the temperature is pressurized and increases is supplied to the pressurizing chamber 18, and the temperature of the fuel in the pressurizing chamber 18 excessively increases. In this regard, according to the present embodiment, even when the temperature of the fuel in the pressurizing chamber 18 excessively increases, it is possible to mitigate the temperature rise of the fuel, and to prevent the generation of air bubbles caused by the fuel vapor. Furthermore, since all the leaking fuel is returned to the suction passage 82, it is possible to omit a passage for returning the leaking fuel to the fuel tank 160 and a device for cooling the leaking fuel.

When the fuel discharge amount Q by one discharge operation of the high-pressure fuel pump 130 increases, the fuel discharge amount in a predetermined period by the high-pressure fuel pump 130 increases. In this regard, when increasing the fuel discharge amount Q, the number of times of discharge operations in the predetermined period of the high-pressure fuel pump 130 is reduced. Therefore, when executing the control to lower the fuel temperature, it is possible to prevent an increase in fuel discharge amount in the predetermined period by the high-pressure fuel pump 130. Here, the operation which does not perform the discharge is an operation of returning all of the suction amount to the suction chamber 91 without energization to the coil 73 in the returning step after suctioning the fuel to the pressurizing chamber 18. In this case, since fuel is not compressed, the leaking fuel having a high temperature is not generated.

In addition, the above-described embodiment may be modified as follows. The same members as those of the above-described embodiment will be given the same reference numerals, and the description thereof will be omitted.

Figure 12:
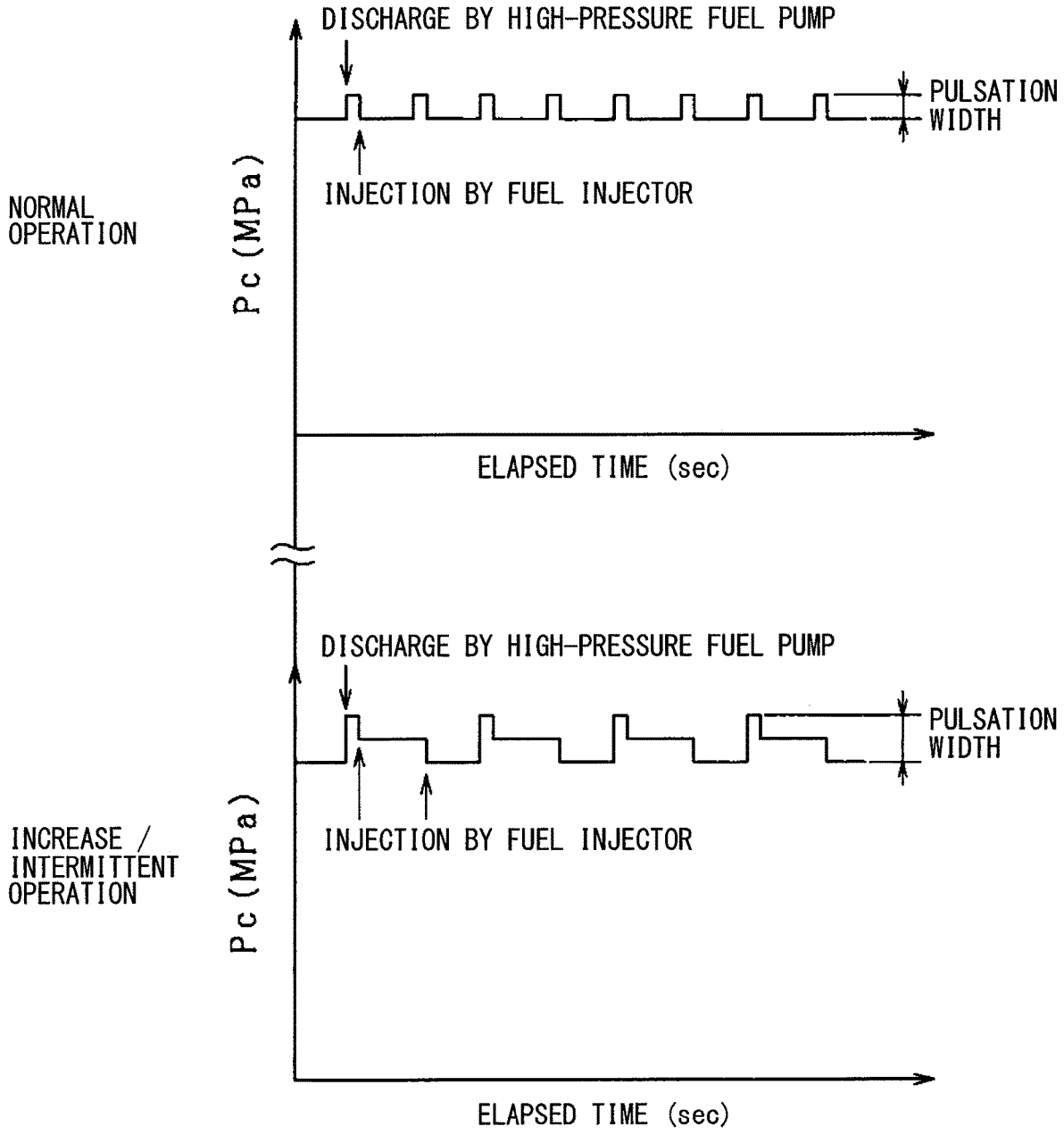
FIG. 12 is a schematic view illustrating fluctuation of a rail pressure due to fuel discharge of a high-pressure fuel pump and injection of a fuel injection valve.

FIG. 12 is a schematic view illustrating fluctuation of the rail pressure Pc due to fuel discharge of the high-pressure fuel pump 130 and injection of the fuel injection valve 150. There is a concern that the pulsation width of the rail pressure Pc becomes excessively large when the fuel discharge amount Q of the fuel excessively increases when increasing the fuel discharge amount Q by one discharge operation of the high-pressure fuel pump 130. There is a possibility that, when the pulsation width is large, the accuracy of the injection amount of the fuel injection valve 150 decreases. Here, the ECU 100 (corresponding to the discharge amount control unit) may set the discharge amount Q such that the pulsation width of the rail pressure Pc becomes smaller than the allowable value when increasing the discharge amount Q. Normally, even when the discharge amount of the high-pressure fuel pump 130 increases such that the fuel in the pressurizing chamber 18 does not become air bubbles, by increasing the volume of the delivery pipe 140 such that the pulsation width does not become excessively large, or by feeding back the rail pressure Pc to energization time to the fuel injection valve 150 by predicting the rail pressure Pc at the injection time point of the fuel injection valve 150, adaptation is possible such that the injection amount accuracy is kept above a certain level even under a certain level of pulsation. According to this, it is possible to select the discharge amount that can prevent generation of air bubbles, and the discharge amount that can allow the pulsation width of the rail pressure Pc to be within a predetermined range. According to the configuration, it is possible to prevent the pulsation width of the holding pressure from becoming excessively large.

Here, with respect to the low rail pressure Pc, the pulsation width of the rail pressure Pc becomes relatively large when the discharge amount Q increases. Therefore, an appropriate allowable value of the pulsation width of the rail pressure Pc changes in accordance with the increase and decrease of the rail pressure Pc. Therefore, the ECU 100 may set the discharge amount Q within a range where the pulsation width of the rail pressure Pc becomes smaller than the allowable value, based on the rail pressure Pc. Further, based on the target rail pressure Pct, the discharge amount of the high-pressure fuel pump 130, the discharge frequency, and the injection amount of the fuel injection valve 150, the pulsation width of the rail pressure Pc is predicted, and when the pulsation width is larger than the allowable value, the discharge amount Q may be reduced. According to the configuration, it is possible to make the pulse width of the rail pressure Pc appropriately smaller than the allowable value. Based on the target rail pressure Pct instead of the rail pressure Pc, the discharge amount Q may be set within a range in which the pulsation width of the rail pressure Pc becomes smaller than the allowable value.

Further, the ECU 100 may decrease the discharge amount Q when the pulse width of the rail pressure Pc detected by the rail pressure sensor 101 is larger than the allowable value. According to the configuration, when the pulsation width of the rail pressure Pc becomes larger than the allowable value when the discharge amount Q increases, it is possible to reduce the pulsation width of the rail pressure Pc by reducing the discharge amount Q.

Second Embodiment

Hereinafter, a second embodiment will be described focusing on differences from the first embodiment. The same members as those of the first embodiment will be given the same reference numerals, and the description thereof will be omitted.

Figure 13:
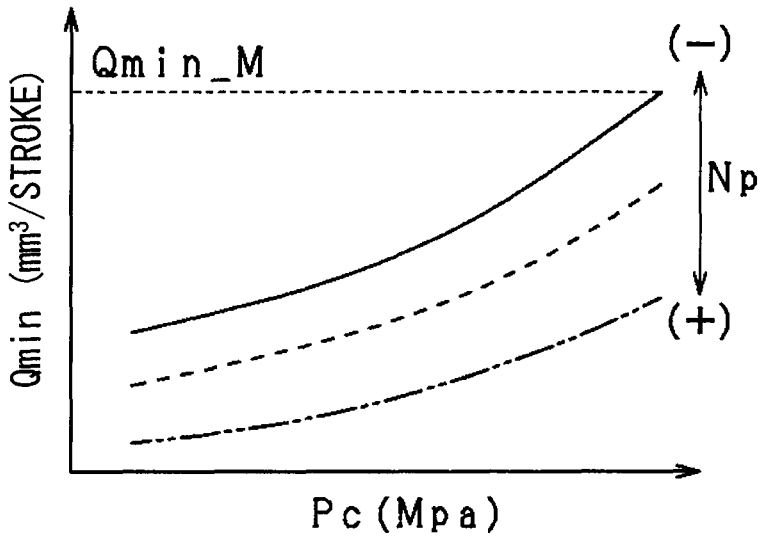
FIG. 13 is a characteristic chart illustrating a relationship of the rail pressure, the pump rotation speed, and the necessary minimum discharge amount Qmin.

When the supply temperature Tin and the feed pressure Pf are determined, the minimum discharge amount Qmin for preventing generation of air bubbles for each of the rotation speed Np and the rail pressure Pc from the characteristic chart (map) of FIG. 5. As illustrated in FIG. 13, the minimum discharge amount Qmin increases as the rail pressure Pc increases and as the rotation speed Np decreases, the minimum discharge amount Qmin increases.

In the first embodiment, the characteristic chart of FIG. 5 is stored as a map in the ROM. In the second embodiment, instead of the characteristic chart of FIG. 5, the characteristic chart of FIG. 13 is stored as a map. The feed pressure Pf uses the lowest pressure PF_min, which is the lowest pressure in a state of being used, rather than a measuring pressure from time to time. At the lowest pressure PF_min, the air bubble generation temperature Tv takes the lowest temperature Tv_min which is the lowest temperature in a state of being used. Meanwhile, the supply temperature Tin also uses the maximum temperature Tin_max which is the highest temperature in the assumed use state, rather than measuring the temperature time to time. Even when the fuel is supplied at the maximum temperature Tin_max to be used, the allowable minimum temperature rise amount ΔTp_min can be obtained because the temperature of the fuel does not exceed the minimum temperature Tv_min. FIG. 13 is a characteristic chart obtained by calculating and linking the minimum discharge amount Qmin which is the minimum discharge amount necessary for the temperature rise amount to be within the minimum temperature rise amount ΔTp_min, for each of the rotation speed Np and the rail pressure Pc.

Figure 14:
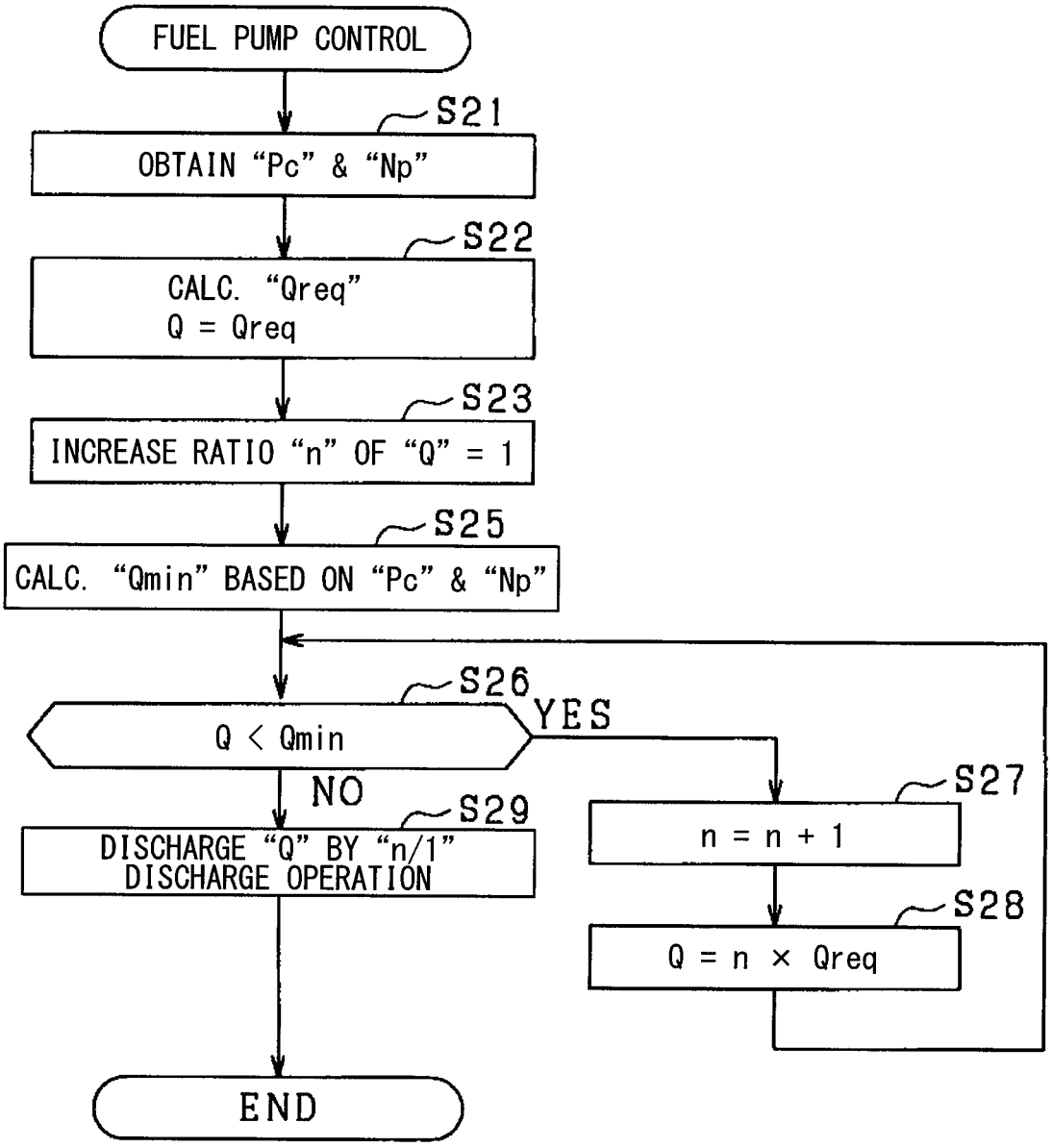
FIG. 14 is a flowchart illustrating a procedure of fuel pump control of a second embodiment.

FIG. 14 is a flowchart illustrating the procedure of fuel pump control according to the present embodiment. This series of processing is executed by the ECU 100.

First, the rail pressure Pc and the pump rotation speed Np are obtained (S21). Subsequently, based on the fuel injection amount by the fuel injection valve 150 and the target rail pressure Pct, the required discharge amount Qreq to the high-pressure fuel pump 130 is calculated (S22). The increase ratio "n" of the discharge amount Q is set to "1" of the initial value (S23).

Subsequently, based on the rail pressure Pc, the pump rotation speed Np, and the map, the minimum discharge amount Qmin is calculated (S25). More specifically, the rail pressure Pc and the rotation speed Np are input into the characteristic chart illustrated in FIG. 13, and the minimum discharge amount Qmin is calculated.

Subsequently, it is determined whether or not the discharge amount Q is smaller than the minimum discharge amount Qmin (S26). In the determination, when it is determined that the discharge amount Q is smaller than the minimum discharge amount Qmin (S26: YES), "1" is added to the increase ratio "n" of the injection amount (S27). Subsequently, by multiplying the increase ratio "n" by the required discharge amount Qreq, the discharge amount Q is calculated (S28). Thereafter, based on the calculated discharge amount Q, the process from S26 is executed again.

Meanwhile, in the determination of S26, when it is determined that the discharge amount Q is not smaller than the minimum discharge amount Qmin (S26: NO), the high-pressure fuel pump 130 is operated to discharge the discharge amount Q (n×Qreq) at that time with the number of times of discharge operations of 1/n times (S29). Thereafter, the series of processing ends (END).

In addition, the processing of S22 corresponds to the processing as the discharge amount setting unit and the processing of S26 to S28 corresponds to the processing as the discharge amount control unit.

The present embodiment described in detail above has the following advantages. Here, only advantages different from those of the first embodiment will be described.

When the set discharge amount Q is smaller than the minimum discharge amount Qmin, the discharge amount Q increases. Therefore, the amount of fuel flowing through the pressurizing chamber 18 by one discharge operation increases, and the cooling effect of the flowing fuel is improved. In addition, since the ratio of the leakage amount to the fuel replacement amount on the inside of the high-pressure fuel pump 130 is reduced, there is no case where the temperature of the fuel supplied to the pressurizing chamber 18 excessively increases. Therefore, generation of the air bubbles caused by the fuel vapor can be prevented.

Since the minimum discharge amount Qmin is set based on the rail pressure Pc and the pump rotation speed Np, control is performed to lower the fuel temperature in consideration of the difference in temperature rise of the fuel due to the difference between the rail pressure Pc and the rotation speed Np.

Compared to the first embodiment, the feed pressure sensor 103 and the fuel temperature sensor 104 are unnecessary, and a simple system can be obtained. In addition, it is possible to reduce the amount of stored information in the ROM and the number of times of calculation processing by the CPU, and to make it possible to provide a simple information processing system.

In addition, by applying the rail pressure Pc detected by the rail pressure sensor 101 to the map of FIG. 13, the minimum discharge amount Qmin (corresponding to the threshold value) may be calculated, or the minimum discharge amount Qmin may be calculated by applying the target rail pressure Pct.

Third Embodiment

Hereinafter, a third embodiment will be described focusing on differences from the second embodiment. The same members as those of the second embodiment will be given the same reference numerals, and the description thereof will be omitted.

Figure 15:
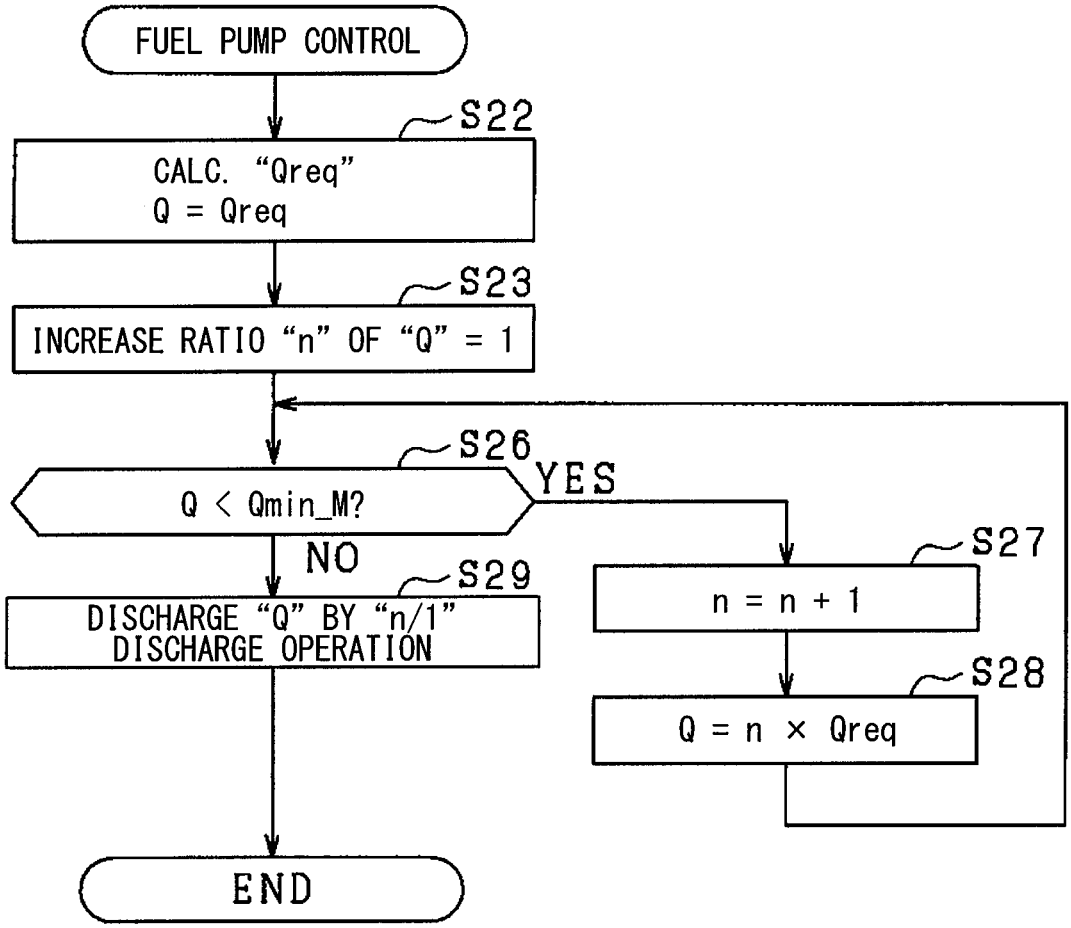
FIG. 15 is a flowchart illustrating a procedure of fuel pump control of a third embodiment.

FIG. 15 is a flowchart illustrating the procedure of fuel pump control according to the present embodiment. This series of processing is executed by the ECU 100.

In FIG. 13, the maximum value Qmin_M of the necessary minimum discharge amount is acquired from the highest rail pressure Pc to be used and the lowest rotation speed Np to be used. The maximum value Qmin_M is an amount at which the fuel supplied to the pressurizing chamber 18 does not become air bubbles under any operating condition when discharging an amount larger than the maximum value Qmin_M. In the third embodiment, the map of the characteristic chart is not stored in the ROM, but the value of the maximum value Qmin_M is stored.

First, the processing in S22 and S23 is the same as the processing in S22 and S23 in FIG. 14. Subsequently, it is determined whether or not the discharge amount Q is smaller than the maximum value Qmin_M of the necessary minimum discharge amount (S26). In the determination, when it is determined that the discharge amount Q is smaller than the maximum value Qmin_M (S26: YES), "1" is added to the increase ratio "n" of the injection amount (S27). Subsequently, by multiplying the increase ratio "n" by the required discharge amount Qreq, the discharge amount Q is calculated (S28). Thereafter, based on the calculated discharge amount Q, the process from S26 is executed again.

Meanwhile, in the determination of S26, when it is determined that the discharge amount Q is not smaller than the minimum value Qmin_M of the necessary minimum discharge amount (S26: NO), the high-pressure fuel pump 130 is operated to discharge the discharge amount Q (n×Qreq) at that time with the number of times of discharge operations of 1/n times (S29). Thereafter, the series of processing ends (END).

In addition, the processing of S22 corresponds to the processing as the discharge amount setting unit and the processing of S26 to S28 corresponds to the processing as the discharge amount control unit. By doing so, compared to the second embodiment, the rail pressure sensor 101 and the cam angle sensor 102 for detecting the rotation speed Np become unnecessary, and a more simple system can be obtained. In addition, it is possible to reduce the amount of stored information in the ROM and the number of times of calculation processing by the CPU, and to make it possible to provide a simple information processing system.

The present embodiment described in detail above has the following advantages. Here, only advantages different from those of the first and second embodiments will be described.

The fuel discharge amount Q by one discharge operation of the high-pressure fuel pump 130 is set to be larger than the minimum value Qmin_M of the necessary minimum discharge amount regardless of the set required discharge amount Qreq. Therefore, since the ratio of the leakage amount to the fuel replacement amount on the inside of the high-pressure fuel pump 130 is reduced, there is no case where the temperature of the fuel supplied to the pressurizing chamber 18 excessively increases. Therefore, generation of the air bubbles caused by the fuel vapor can be prevented.

Fourth Embodiment

Hereinafter, a fourth embodiment will be described focusing on differences from the second embodiment. The same members as those of the first embodiment will be given the same reference numerals, and the description thereof will be omitted. First, as can be ascertained from FIG. 5, when the rail pressure Pc is sufficiently low, depending on the rail pressure Pc, there is a case where the temperature does not rise as air bubbles are generated even when the discharge amount Q is low. The rail pressure Pc at which the temperature rise falls within the limit value is stored in the ROM as a threshold value Ph. The threshold value Ph may be set to a value which is slightly smaller than the rail pressure Pc at which the temperature rise is the limit value in consideration of the measurement error or the like of the sensor. In addition, in the embodiment, when the rail pressure Pc or the target rail pressure Pct is higher than the threshold value Ph, a control mode for determining the discharge amount Q based on the temperature rise amount ΔTp is entered.

Figure 16:
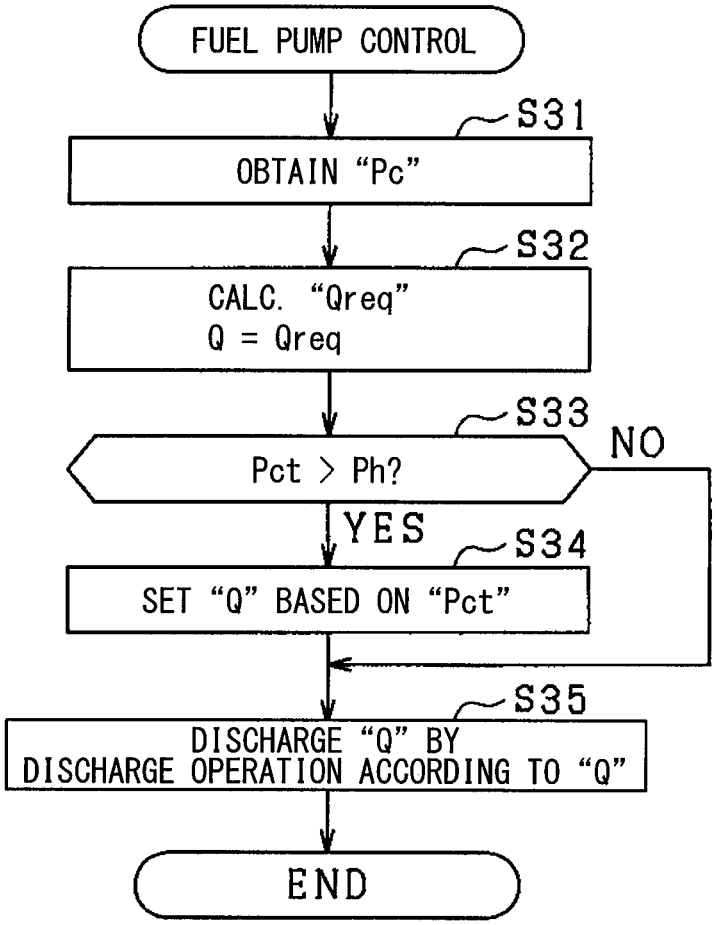
FIG. 16 is a flowchart illustrating a procedure of fuel pump control of a fourth embodiment.

FIG. 16 is a flowchart illustrating the procedure of fuel pump control according to the present embodiment. This series of processing is executed by the ECU 100.

First, the target rail pressure Pct is obtained (S31). Subsequently, based on the fuel injection amount by the fuel injection valve 150 and the target rail pressure Pct, the required discharge amount Qreq to the high-pressure fuel pump 130 is calculated (S32).

Subsequently, it is determined whether or not the target rail pressure Pct is higher than the threshold value Ph (S33).

In the determination in S33, when it is determined that the target rail pressure Pct is higher than the threshold value Ph (S33: YES), the discharge amount Q is set based on the target rail pressure Pct (S34). More specifically, with reference to the map of FIG. 5, at the target rail pressure Pct, the discharge amount Q is set to be larger than the minimum discharge amount Qmin (corresponding to the predetermined amount) which is the temperature rise amount ΔTp at which air bubbles are generated.

Subsequently, the high-pressure fuel pump 130 is operated such that the discharge amount Q at that time is discharged at the number of times of discharge operations in accordance with the discharge amount Q (S35). In addition, in the determination in S33, when it is determined that the target rail pressure Pct is not higher than the threshold value Ph (S33: NO), the processing of S35 is also executed. Thereafter, the series of processing ends (END).

In addition, the processing of S32 corresponds to the processing as the discharge amount setting unit and the processing of S33 to S34 corresponds to the processing as the discharge amount control unit.

The present embodiment described in detail above has the following advantages. Here, only advantages different from those of the first to third embodiments will be described.

When the target rail pressure Pct is higher than the threshold value Ph, the fuel discharge amount Q by one discharge operation of the high-pressure fuel pump 130 is set to be larger than the minimum discharge amount Qmin regardless of the set required discharge amount Qreq. Therefore, the amount of fuel flowing through the pressurizing chamber 18 by one discharge operation increases, and the cooling effect of the flowing fuel is improved. Therefore, generation of the air bubbles caused by the fuel vapor can be prevented.

When the target rail pressure Pct is high, since the pressure of the fuel in the pressurizing chamber 18 increases, the amount of increase in fuel temperature due to pressurization increases. Therefore, when the target rail pressure Pct is higher than the threshold value Ph, the degree of increase in temperature of the fuel changes in accordance with the height of the target rail pressure Pct. In this regard, since the minimum discharge amount Qmin is set based on the target rail pressure Pct, it is possible to appropriately lower the fuel temperature in consideration of the difference in temperature rise of the fuel due to the difference of the target rail pressure Pct.

In addition, the above-described embodiment may be modified as follows. The same members as those of the above-described embodiment will be given the same reference numerals, and the description thereof will be omitted.

When the rail pressure Pc detected by the rail pressure sensor 101 is higher than the threshold value Ph, the discharge amount Q may be set to be larger than the minimum discharge amount Qmin.

The minimum discharge amount Qmin may be set based on the rail pressure Pc. Further, regardless of the target rail pressure Pct or the rail pressure Pc, the minimum discharge amount Qmin may be set to a constant amount that can prevent generation of air bubbles caused by the fuel vapor.

When the moving speed of the plunger 11 of the high-pressure fuel pump 130 is low, the ratio of the leaking fuel to the discharge amount Q increases, and the temperature of the fuel in the pressurizing chamber 18 is likely to rise. Here, even when the moving speed of the plunger 11 is lower than the threshold value, the ECU 100 (corresponding to the discharge amount control unit) may set the discharge amount Q to the minimum discharge amount Qmin (corresponding to the predetermined amount) regardless of the set required discharge amount Qreq. Even with the configuration, when the temperature of the fuel in the pressurizing chamber 18 is likely to rise, it is possible to execute control to lower the fuel temperature.

In addition, each of the above-described embodiments can also be changed as follows. The same members as those of each of the above-described embodiments will be given the same reference numerals, and the description thereof will be omitted.

The fuel temperature sensor 104 can also be provided in the suction chamber 91. In short, the fuel temperature sensor 104 may be any sensor as long as the sensor detects the supply temperature Tin which is the temperature of the fuel supplied to the high-pressure fuel pump 130.

The pump rotation speed Np can also be calculated based on the detection signal of the crank angle sensor which detects the crank angle of the engine 170.

The detection value of the flow rate sensor which detects the discharge amount of the high-pressure fuel pump 130 can also be appropriately used instead of the required discharge amount Qreq or the discharge amount Q.

The pressure chamber temperature Tp which is the temperature of the fuel in the pressurizing chamber 18 can also be detected by a temperature sensor or the like.

The high-pressure fuel pump 130 may include the multiple cylinders 80 and the plungers 11. In this case, when the fuel discharge amount Q increases, the operation of some of the cylinders 80 and the plungers 11 is stopped, and accordingly, the number of times of discharge operations of the high-pressure fuel pump 130 may be reduced in a predetermined period.

The fuel injection device 110 may include the multiple high-pressure fuel pumps 130. In this case, when the fuel discharge amount Q increases, the operation of some of the high-pressure fuel pumps 130 is stopped, and accordingly, the number of times of discharge operations of the multiple high-pressure fuel pumps 130 may be reduced in a predetermined period.

In order to increase the fuel discharge amount Q, instead of increasing the increase ratio "n" of the discharge amount Q one by one, the increase ratio "n" may increase two by two or "n" may increase to 4 at a time.

As illustrated by the broken line in FIG. 1, a pressure reducing valve 95 for lowering the pressure of the fuel in the delivery pipe 140 is provided, and when increasing the fuel discharge amount Q, it is also possible to lower the pressure of the fuel in the delivery pipe 140 by the pressure reducing valve 95 without reducing the number of times of discharge operations of the high-pressure fuel pump 130 in a predetermined period.

In addition to the return passage 86 for returning the leaking fuel to the suction passage 82, a passage for returning a part of the leaking fuel to the fuel tank 160 may be provided.

The high-pressure fuel pump 130 may be provided with the normally closed type metering valve 60. As the high-pressure fuel pump 130, an electric high-pressure fuel pump can also be used.

It is also possible to employ the high-pressure fuel pump 130 which does not have the metering valve 60 and controls the discharge amount in a predetermined period by the pump rotation speed Np. In this case, the ECU 100 (discharge amount control unit) may increase the rotation speed of the high-pressure fuel pump 130 instead of increasing the discharge amount of fuel by one discharge operation of the high-pressure fuel pump 130. Even with such a configuration, by increasing the moving speed of the plunger 11 of the high-pressure fuel pump 130, it is possible to reduce the ratio of leaking fuel to the discharge amount Q, and to prevent the temperature rise of the fuel in the pressurizing chamber 18. In addition, after raising the rotation speed of the high-pressure fuel pump 130, the high-pressure fuel pump 130 may be intermittently stopped, or the pressure of the fuel in the delivery pipe 140 may be lowered by the pressure reducing valve 95. In short, it is possible to adopt a fuel pump as long as the fuel pump repeatedly executes the discharge operation of pressurizing and discharging the fuel in the pressurizing chamber 18 with the pressurizing member.

Each of the above-described embodiments can be applied not only to a gasoline engine but also to the engine 170 using another liquid fuel. In this case, as the fuel vapor pressure characteristics, vapor pressure characteristics which corresponds to the fuel to be used may be used, or the vapor pressure characteristics corresponding to the fuel having the highest vapor pressure among the assumed fuels may be used.

Although the present disclosure has been described in accordance with the embodiments, it is understood that the present disclosure is not limited to the embodiments or structures. The present disclosure also includes various modification examples or variations within the equivalent scope. In addition, various combinations or forms, as well as other combinations and forms including only one element, more than one, or less, are also included within the scope or idea of the present disclosure.

The invention claimed is:

1. A fuel pump control device which controls a fuel pump repeatedly executing a discharge operation of pressurizing and discharging fuel in a pressurizing chamber with a pressurizing member, the control device comprising:

a pressurizing chamber temperature obtaining unit which obtains a pressurizing chamber temperature which is a temperature of the fuel in the pressurizing chamber; and a discharge amount control unit which increases a fuel discharge amount by one discharge operation of the fuel pump when the pressurizing chamber temperature obtained by the pressurizing chamber temperature obtaining unit is higher than a threshold value, wherein a holding container which holds the fuel discharged by the fuel pump in a pressurized state is connected to the fuel pump, the pressurizing chamber temperature obtaining unit includes a supply temperature obtaining unit which obtains a supply temperature which is a temperature of the fuel to be supplied to the fuel pump, and a holding pressure obtaining unit which obtains a holding pressure which is a pressure of the fuel in the holding container, and the pressurizing chamber temperature obtaining unit obtains the pressurizing chamber temperature based on the supply temperature obtained by the supply temperature obtaining unit, the holding pressure obtained by the holding pressure obtaining unit, a speed of the discharge operation of the fuel pump, and the fuel discharge amount by one discharge operation of the fuel pump.

2. The fuel pump control device according to claim 1, wherein the discharge amount control unit reduces a number of times of the discharge operations in a predetermined period of the fuel pump when increasing the discharge amount of fuel by one discharge operation of the fuel pump.

3. A fuel pump control device which controls a fuel pump repeatedly executing a discharge operation of pressurizing and discharging fuel in a pressurizing chamber with a pressurizing member, the control device comprising:

a pressurizing chamber temperature obtaining unit which obtains a pressurizing chamber temperature which is a temperature of the fuel in the pressurizing chamber; and a discharge amount control unit which increases a fuel discharge amount by one discharge operation of the fuel pump when the pressurizing chamber temperature obtained by the pressurizing chamber temperature obtaining unit is higher than a threshold value, wherein the discharge amount control unit reduces a number of times of the discharge operations in a predetermined period of the fuel pump when increasing the discharge amount of fuel by one discharge operation of the fuel pump.

4. The fuel pump control device according to claim 1, wherein the holding container which holds the fuel discharged by the fuel pump in a pressurized state is connected to the fuel pump, and the discharge amount control unit sets the fuel discharge amount by one discharge operation of the fuel pump such that a pulsation width of the holding pressure which is a pressure of the fuel in the holding container becomes smaller than an allowable value when the discharge amount control unit increases the fuel discharge amount by one discharge operation of the fuel pump.

5. A fuel pump control device which controls a fuel pump repeatedly executing a discharge operation of pressurizing and discharging fuel in a pressurizing chamber with a pressurizing member, the control device comprising:

a pressurizing chamber temperature obtaining unit which obtains a pressurizing chamber temperature which is a temperature of the fuel in the pressurizing chamber; and a discharge amount control unit which increases a fuel discharge amount by one discharge operation of the fuel pump when the pressurizing chamber temperature obtained by the pressurizing chamber temperature obtaining unit is higher than a threshold value, wherein a holding container which holds the fuel discharged by the fuel pump in a pressurized state is connected to the fuel pump, and the discharge amount control unit sets the fuel discharge amount by one discharge operation of the fuel pump such that a pulsation width of the holding pressure which is a pressure of the fuel in the holding container becomes smaller than an allowable value when the discharge amount control unit increases the fuel discharge amount by one discharge operation of the fuel pump.

6. The fuel pump control device according to claim 4, wherein the discharge amount control unit sets the fuel discharge amount by one discharge operation of the fuel pump within a range in which the pulsation width of the holding pressure becomes smaller than the allowable value based on the holding pressure.

7. The fuel pump control device according to claim 4, further comprising:

a holding pressure detection unit which detects the holding pressure that is the pressure of the fuel in the holding container, wherein the discharge amount control unit reduces the fuel discharge amount by one discharge operation of the fuel pump when the pulsation width of the holding pressure detected by the holding pressure detection unit is larger than the allowable value.

8. The fuel pump control device according to claim 1, further comprising:

a supply pressure obtaining unit which obtains a supply pressure that is a pressure of fuel supplied to the fuel pump, wherein the threshold value is set based on a temperature at which a fuel vapor pressure becomes the supply pressure obtained by the supply pressure obtaining unit.

9. The fuel pump control device according to claim 1, wherein the fuel pump includes a return passage for returning a leaking fuel which is leaked from the pressurizing chamber without being discharged in the discharge operation, to a supply passage for supplying fuel to the pressurizing chamber.

10. A fuel pump control device which controls a fuel pump repeatedly executing a discharge operation of pressurizing and discharging fuel in a pressurizing chamber with a pressurizing member, and in which a holding container, which holds the fuel discharged by the fuel pump in a pressurized state, is connected to the fuel pump, the control device comprising:

a discharge amount setting unit which sets a fuel discharge amount by one discharge operation of the fuel pump based on a holding pressure which is a pressure of the fuel in the holding container; and a discharge amount control unit which increases a fuel discharge amount by one discharge operation of the fuel pump when the discharge amount set by the discharge amount setting unit is smaller than a threshold value.

11. The fuel pump control device according to claim 10, wherein the threshold value is set based on the holding pressure and a speed of the discharge operation.

12. A fuel pump control device which controls a fuel pump repeatedly executing a discharge operation of pressurizing and discharging fuel in a pressurizing chamber with a pressurizing member, and in which a holding container, which holds the fuel discharged by the fuel pump in a pressurized state, is connected to the fuel pump, the control device comprising:

a discharge amount setting unit which sets a fuel discharge amount by one discharge operation of the fuel pump based on a holding pressure which is a pressure of the fuel in the holding container; and a discharge amount control unit which sets the fuel discharge amount by one discharge operation of the fuel pump to be larger than a predetermined amount regardless of the discharge amount set by the discharge amount setting unit when the discharge amount is smaller than a threshold value.

13. A fuel pump control device which controls a fuel pump repeatedly executing a discharge operation of pressurizing and discharging fuel in a pressurizing chamber with a pressurizing member, and in which a holding container, which holds the fuel discharged by the fuel pump in a pressurized state, is connected to the fuel pump, the control device comprising:

a discharge amount setting unit which sets a fuel discharge amount by one discharge operation of the fuel pump based on a holding pressure which is a pressure of the fuel in the holding container; and a discharge amount control unit which sets the fuel discharge amount by one discharge operation of the fuel pump to be larger than a predetermined amount regardless of the discharge amount set by the discharge amount setting unit when the holding pressure is higher than a threshold value.

14. The fuel pump control device according to claim 12, wherein the predetermined amount is set based on the holding pressure.

15. The fuel pump control device according to claim 13, wherein the fuel pump has a return passage for returning a leaking fuel which is leaked from the pressurizing chamber without being discharged in the discharge operation, to a supply passage for supplying fuel to the pressurizing chamber, and the discharge amount control unit sets the fuel discharge amount by one discharge operation of the fuel pump to be larger than a predetermined amount regardless of the discharge amount set by the discharge amount setting unit when a moving speed of the pressurizing member is lower than a threshold value.

* * * * *